US007558507B2

(12) United States Patent
Furukawa et al.

(10) Patent No.: US 7,558,507 B2
(45) Date of Patent: Jul. 7, 2009

(54) IMAGE FORMING APPARATUS, AND PRESSURE FOGGING PREVENTION

(75) Inventors: Toshio Furukawa, Nagoya (JP); Tomoaki Hattori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 661 days.

(21) Appl. No.: 10/388,405

(22) Filed: Mar. 17, 2003

(65) Prior Publication Data

US 2003/0185591 A1 Oct. 2, 2003

(30) Foreign Application Priority Data

Mar. 26, 2002 (JP) ..... 2002-085770
Mar. 27, 2002 (JP) ..... 2002-088730

(51) Int. Cl.
*G03G 15/00* (2006.01)

(52) U.S. Cl. ..... 399/159

(58) Field of Classification Search ..... 399/159, 399/162, 279, 313, 111, 113, 302
See application file for complete search history.

(56) References Cited

U.S. PATENT DOCUMENTS 4,847,657 A * 7/1989 Hanada et al. ..... 399/187
4,868,611 A 9/1989 Germain
4,876,572 A * 10/1989 Nagatsuna ..... 399/111
5,008,706 A 4/1991 Ohmori et al.
5,291,254 A * 3/1994 Shimada et al. ..... 399/46
5,758,225 A * 5/1998 Yoo et al. ..... 399/55
5,774,169 A * 6/1998 Ikegawa et al. ..... 347/262
5,905,929 A 5/1999 Cho et al.
5,956,548 A * 9/1999 Hattori ..... 399/168
5,966,561 A * 10/1999 Yamaguchi ..... 399/66
6,029,022 A * 2/2000 Takase ..... 399/66
6,097,921 A * 8/2000 Kageyama ..... 399/306
6,534,227 B2 3/2003 Kabata et al.
6,649,313 B2 11/2003 Kabata et al.
6,677,091 B2 * 1/2004 Niimi ..... 430/66
2001/0028815 A1 10/2001 Sato

FOREIGN PATENT DOCUMENTS

CN 1043206 A 6/1990
CN 1219691 A 6/1999
JP 62-219808 9/1987

(Continued)

*Primary Examiner*—Quana M Grainger
(74) *Attorney, Agent, or Firm*—Oliff & Berridge, PLC

(57) ABSTRACT

The pressure between a developing roller and a photosensitive drum is set to 0.24 MPa. Because the pressure is smaller than 0.31 MPa, if the potential difference ΔV between the non-image forming part on the photosensitive drum and the electrically-charged polymer toner on the surface of the developing roller is at the preset proper voltage (300 volts), pressure fogging will be prevented. Because the pressure is 0.24 MPa or less, even if the potential difference varies within the range of 200 volts to 400 volts that occurs in practice, pressure fogging will be prevented. By resetting the pressure to 0.22 MPa, even if the potential difference ΔV varies in a wider voltage range of 100 to 400 volts, pressure fogging will be prevented. In this way, by setting the pressure between the developing roller and the photosensitive drum appropriately, pressure fogging can be prevented even when using the opposite-direction developing method and polymer toner.

18 Claims, 12 Drawing Sheets

FOREIGN PATENT DOCUMENTS

| | | | | |
|---|---|---|---|---|
| JP | A-01-189663 | | | 1/1989 |
| JP | 2-64561 | | | 3/1990 |
| JP | 3-88720 | | | 9/1991 |
| JP | 403292434 | A | * | 12/1991 |
| JP | 4-51155 | | | 2/1992 |
| JP | A 5-40355 | | | 2/1993 |
| JP | A-06-059564 | | | 3/1994 |
| JP | A 6-282158 | | | 10/1994 |
| JP | 7-334029 | | | 12/1995 |
| JP | A 8-63044 | | | 3/1996 |
| JP | A-08-240991 | | | 9/1996 |
| JP | A-09-101674 | | | 4/1997 |
| JP | 9-160274 | | | 6/1997 |
| JP | 9-222746 | | | 8/1997 |
| JP | 11015178 | A | * | 1/1999 |
| JP | A 11-231743 | | | 8/1999 |
| JP | 11-282274 | | | 10/1999 |
| JP | 11-305474 | | | 11/1999 |
| JP | A-2000-098708 | | | 4/2000 |
| JP | 2000-168989 | | | 6/2000 |
| JP | B2 3087723 | | | 7/2000 |
| JP | 2000-267506 | | | 9/2000 |
| JP | 2001-188374 | | | 7/2001 |
| JP | 2001-265167 | | | 9/2001 |
| JP | 2001-289630 | | | 10/2001 |
| JP | 2001-312086 | | | 11/2001 |
| JP | 2001-337482 | | | 12/2001 |
| JP | A-2001-356515 | | | 12/2001 |
| JP | 2002-72769 | | | 3/2002 |
| JP | A-2002-072690 | | | 3/2002 |

* cited by examiner

IMAGE FORMING APPARATUS, AND PRESSURE FOGGING PREVENTION

BACKGROUND OF THE INVENTION

1. Field of the Invention

The present invention relates to an image forming apparatus.

2. Description of Related Art

There has been proposed an image forming apparatus of a type, in which an electrostatic latent image is formed on the surface of a photosensitive member. The electrostatic latent image is then developed by toner applied to the photosensitive member. The toner image is then transferred to a recording medium.

As shown in FIG. 1A, this type of image forming apparatus 300 includes: a photosensitive drum 320, a charging unit 360, a developing roller 330, a supply roller 340, a layer-thickness regulating blade 380, and a toner tank 350. The surface of the photosensitive drum 320 is uniformly charged by the charging unit 360. An electrostatic latent image is formed on the surface of the photosensitive drum 320. The supply roller 340 supplies toner from the toner tank 350 to the developing roller 330. More specifically, the developing roller 330 receives toner from the supply roller 340 at a supply point A. The layer-thickness regulating blade 380 removes the excess amount of toner from the developing roller 330. The developing roller 330 supplies a proper amount of toner to the surface of the photosensitive drum 320.

In this way, when toner is supplied to the developing roller 330 from the toner tank 350 by the supply roller 340, excess toner is removed by the layer-thickness regulating blade 380 so that the thickness of the layer of toner on the developing roller 330 becomes uniform. The uniform thickness of toner layer is supplied from the developing roller 330 to the photosensitive drum 320. The toner adheres to the area of the photosensitive drum 320 where the electrostatic latent image is formed. As a result, the electrostatic latent image is developed. A sheet of paper is transported along a transport path 370. The developed toner image is transferred onto the sheet that is being transported along the transport path 370, as a result of which an image is formed on the sheet.

In this example shown in FIG. 1A, the image forming apparatus 300 employs an "opposite-direction" developing method ("against" developing method) for developing the electrostatic latent image. According to the opposite-direction developing method, the photosensitive drum 320 and the developing roller 330 both rotate in the same direction (clockwise direction, in this example) as indicated by the arrows in FIG. 1A. Therefore, the surface of the photosensitive drum 320 and the surface of the developing roller 330 are moving in the opposite directions at the position where they are in contact to develop the electrostatic latent image.

The layer-thickness regulating blade 380 is disposed above the supply point A. The transport path 370 is located above the photosensitive drum 320. Accordingly, the route from a paper supply operation to an image-fixing operation can be arranged in one line. Many kinds of sheets of paper can be used for printing. The image forming apparatus 300 can be made small in size.

The image forming apparatus 300 can be modified to employ a "same-direction" developing method ("with" developing method) as shown in FIG. 1B. According to the same-direction developing method, the photosensitive drum 320 and the developing roller 330 rotate in opposite directions. In this example, the photosensitive drum 320 rotates in the clockwise direction, while the developing roller 330 rotates in the counterclockwise direction as indicated by the arrows in FIG. 1B. Therefore, the surface of the photosensitive drum 320 and the surface of the developing roller 330 are moving in the same direction at the position where they are in contact with each other to develop the electrostatic latent image.

In this case, the layer-thickness regulating blade 380 is disposed below the supply point A. The transport path 370 is located above the photosensitive drum 320. Accordingly, the route from the paper supply operation to the image-fixing operation can be arranged in one line. Many kinds of sheets of paper can be used for printing. The image forming apparatus 300 can be made small in size.

As described above, the position of the layer-thickness regulating blade 380 will vary depending on the employed method of developing the electrostatic latent image.

As shown in FIG. 1B, in the same-direction developing method, the layer-thickness regulating blade 380 is disposed below the supply point A. Accordingly, the excess toner will fall downward and accumulate in the casing (not shown in the drawings) of the image forming apparatus 300. In order to re-use and recycle the toner, it is necessary to return the toner to such a position that the toner can be supplied to the developing roller 330.

Contrarily, according to the opposite-direction developing method, as shown in FIG. 1A, the layer-thickness regulating blade 380 is disposed above the supply point A. This has the advantage that the excess toner will drop back to the supply point A and will be supplied again to the developing roller 330. For this reason, in recent years, the opposite-direction developing method is employed in many image forming apparatuses.

The toner used in the image forming apparatus 300 mainly includes: pigment, resin, and wax. The pigment can be carbon black, for example. The resin is for fixing the pigment to the sheet. The wax is a supplementary fixing agent.

There are mainly two types of toner: pulverized toner, and polymer toner. Pulverized toner is prepared by mixing the pigment, resin and wax mechanically and then by pulverizing the mixture. Polymer toner is prepared by coating the pigment and wax with resin by polymerization to form toner particles of approximate sphere shapes.

The fluidity of pulverized toner is lower than that of polymer toner. Therefore, when pulverized toner is used, fogging can easily occur, and the printing quality is reduced considerably. More specifically, because the fluidity of pulverized toner is not so good as that of polymer toner, the opportunities for pulverized toner to come in contact with the developing roller or blade or the like is lower than that for polymer toner. Hence, toner charged with insufficient charge amount or toner charged to an opposite polarity occur and erroneously develops non-image forming area of the photosensitive drum, onto which toner should not attach. This results in fogging of a resultant image.

On the other hand, the fluidity of polymer toner is high, and therefore this type of fogging does not occur. Higher quality printing is possible in comparison to pulverized toner. For these reasons, it is desirable to employ the opposite-direction developing method and to use polymer toner.

SUMMARY OF THE INVENTION

When the image forming apparatus 300 employs the opposite-direction developing method and uses polymer toner, however, there occurs another type of fogging that is different from the fogging that occurs by the pulverized toner.

There has been proposed a color laser printer of a type that employs a photosensitive belt as the photosensitive body. An electrostatic latent image is formed on the photosensitive belt. Toner, such as polymer toner, is applied from the developing roller onto the photosensitive belt to develop the electrostatic latent image into a toner visible image. The opposite-direction developing method can be employed for developing the latent image. The developed visible image is then transferred to an intermediate transfer belt. Then, the visible image is transferred to a recording medium, where the image is thermally fixed.

As shown in FIG. 2, in this type of color laser printer, a photosensitive belt P1 is wound around a photosensitive belt roller P9. The photosensitive belt P1 includes a base layer P3, on which a vapor deposition layer P5 and a photosensitive layer P7 are formed in this order. The photosensitive layer P7 is formed not to cover a part of the vapor deposition layer P5. The exposed part of the vapor deposition layer P5 is coated with an electrically-conductive paint layer P6 which is made mainly of carbon. An electrical charging brush P11 is provided in the color laser printer to contact the electrically-conductive layer P6.

The photosensitive layer P7 is uniformly charged by a charging device, and is then exposed to light of a desired pattern to form an electrostatic latent image.

While the outer surface of the photosensitive layer P7 is being charged and exposed as described above, the vapor deposition layer P5 supplies electrical charge, whose amount corresponds to the charge on the outer surface, to the inner surface of the photosensitive layer P7 from the electrical charging brush P11.

However, the above-described photosensitive belt P1 has the complicated structure having the base layer P3, the vapor deposition layer P5, the photosensitive layer P7, and the electrically-conductive paint layer P6. Accordingly, the manufacturing cost is high.

Additionally, the vapor deposition layer P5 has low mechanical strength, and therefore the photosensitive layer P7 easily peels from the base layer P3. The photosensitive belt P1 has insufficient durability.

Furthermore, the electrical charging brush P11 has to be mounted in the color laser printer in order to supply electric charge to the photosensitive belt P1. The configuration of the entire color laser printer becomes complicated. The manufacturing cost of the color laser printer becomes high. It is impossible to reduce the size of the color laser printer.

In view of the above-described drawbacks, it is an objective of the present invention to provide an improved image forming apparatus that employs the opposite-direction developing method that uses the polymer toner but that suffers from no fogging.

It is another objective of the present invention to provide an improved photosensitive belt that has a simple configuration, that can be manufactured at a low cost, and that has high durability, and to provide an improved image forming apparatus that has a simple configuration, that can be manufactured at a low cost, and that can be made smaller in size.

In order to attain the above and other objects, the present invention provides an image forming apparatus, comprising: a photosensitive member having a surface forming an electrostatic latent image thereon; a developing agent bearing member having a surface bearing developing agent thereon, the surface of the developing agent bearing member contacting the surface of the photosensitive member at a contact position, the surface of the developing agent bearing member and the surface of the photosensitive member moving in opposite directions from each other at the contact position where they contact with each other, the developing agent bearing member supplying the developing agent to the photosensitive member at the contact position, to thereby develop the electrostatic latent image into a developing agent visible image; and a pressing member pressing the developing agent bearing member and the photosensitive member in a direction toward each other with a contact pressure of less than or equal to 0.31 MPa.

According to another aspect, the preset invention provides an image forming apparatus, comprising: a photosensitive belt including: an electrically conductive base layer; and a photosensitive layer provided over the electrically conductive base layer for forming an electrostatic latent image thereon; and an energy feeding unit feeding an electric energy to the electrically conductive base layer at its surface that is opposite to the other surface of the electrically conductive base layer, on which the photosensitive layer is provided.

According to another aspect, the present invention provides an image forming apparatus, comprising: a photosensitive belt including: an electrically conductive base layer; and a photosensitive layer provided over the electrically conductive base layer for forming an electrostatic latent image thereon; and a supporting unit supporting the photosensitive belt, the supporting unit including an energy feeding unit feeding an electric energy to the electrically conductive base layer at its one surface that is opposite to the other surface of the electrically conductive base layer, on which the photosensitive layer is provided.

According to another aspect, the present invention provides a photosensitive belt comprising: an electrically conductive base layer having a volume resistivity in a range of $10^3$ to $10^9$ Ω·cm (ohms-cm); and a photosensitive layer provided over the electrically conductive base layer for forming an electrostatic latent image thereon.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

Figure 1A:
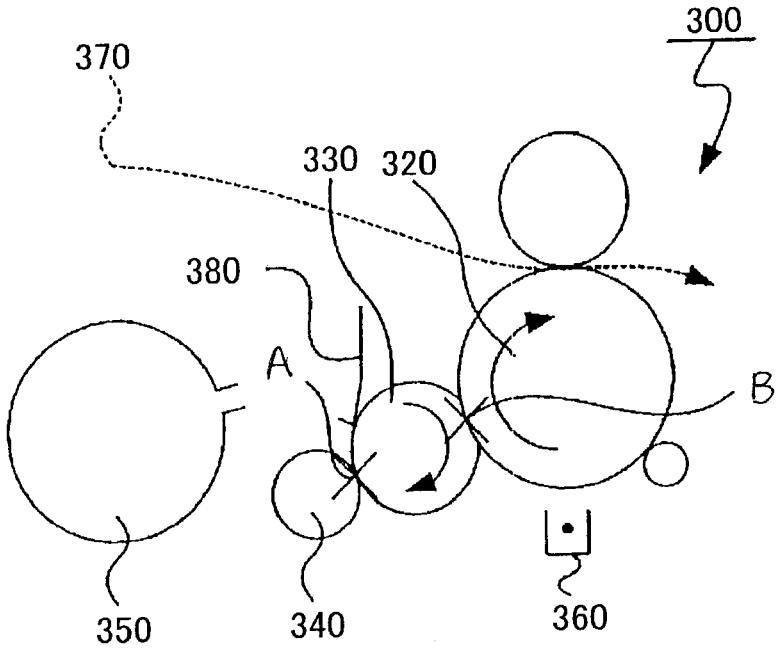
FIG. 1A illustrates an opposite-direction developing method for developing electrostatic latent images in image forming apparatus.
Figure 1B:
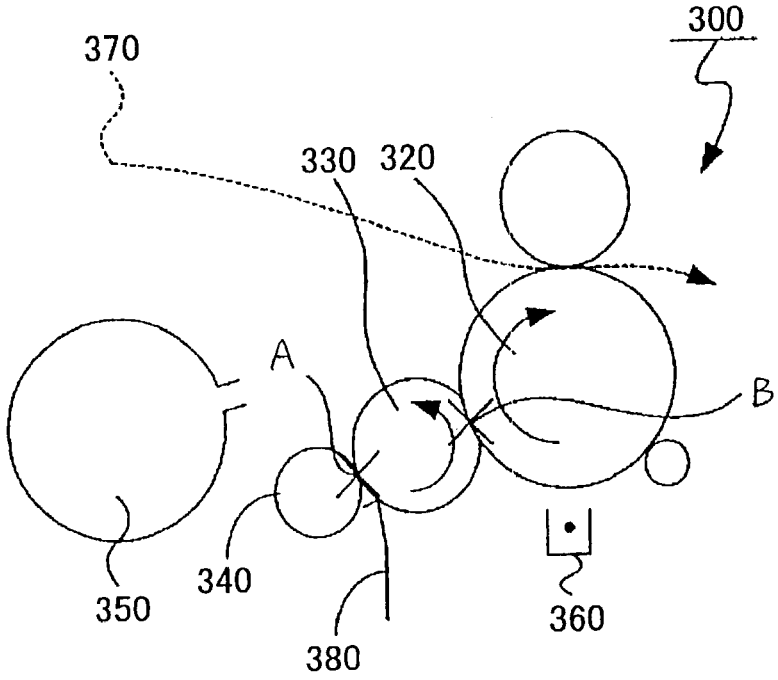
FIG. 1B illustrates a same-direction developing method for developing electrostatic latent images in image forming apparatus.
Figure 2:
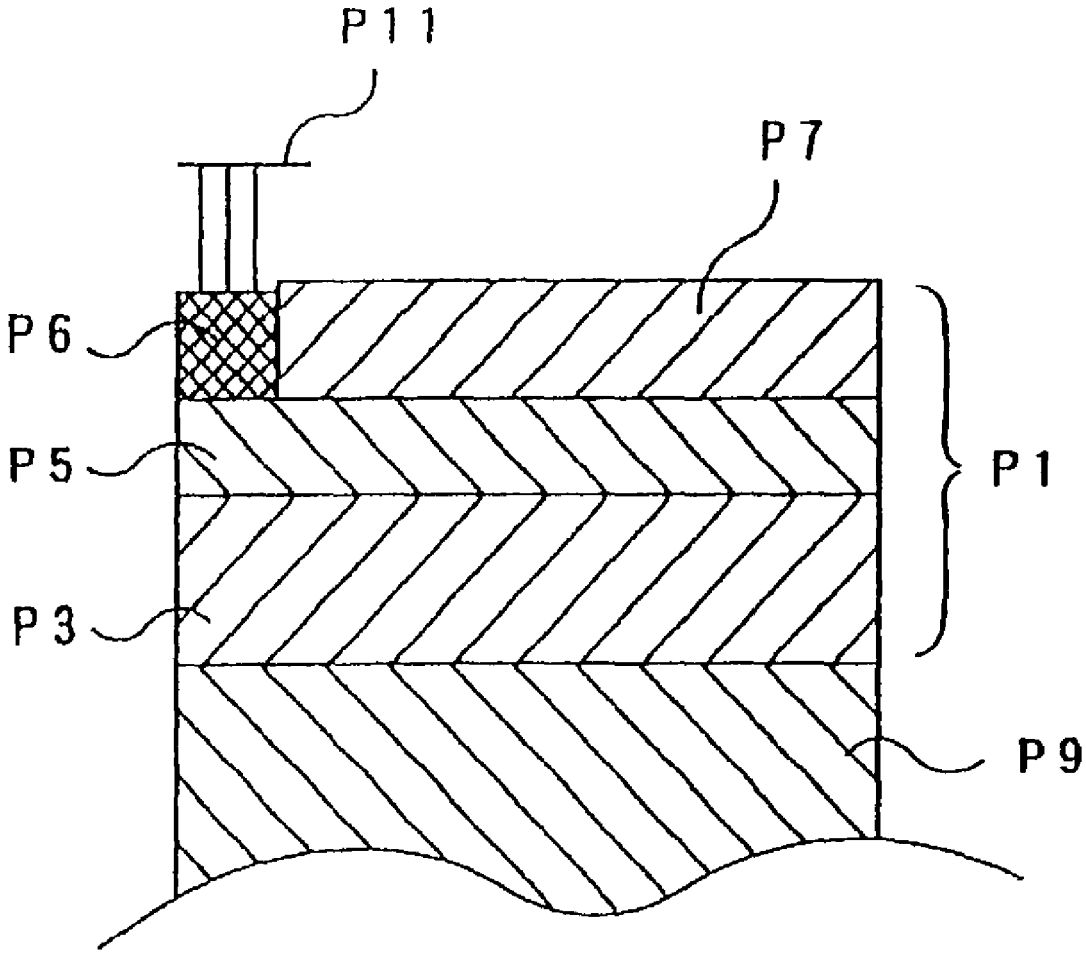
FIG. 2 is a schematic sectional view showing a section taken through a photosensitive belt along its widthwise direction.

An image forming apparatus according to preferred embodiments of the present invention will be described while referring to the accompanying drawings wherein like parts and components are designated by the same reference numerals to avoid duplicating description.

First Embodiment

An image forming apparatus according to a first embodiment of the present invention will be described with reference to FIGS. 3A-5.

Figure 3A:
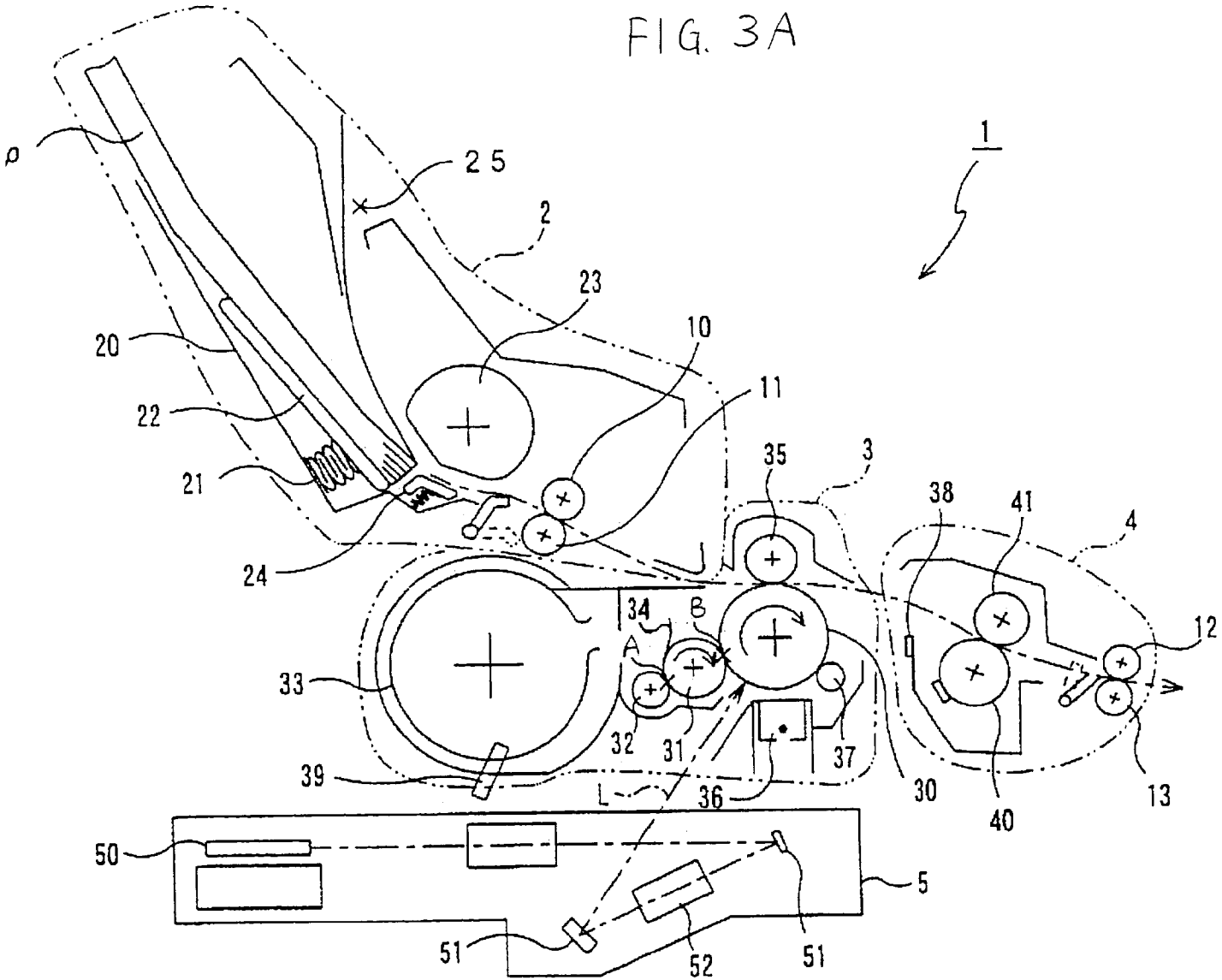
FIG. 3A is a schematic view of a laser printer according to a first embodiment of the present invention.

FIG. 3A shows the internal mechanism of a laser printer 1, which is the image forming apparatus of the first embodiment.

The laser printer 1 is for receiving image data sent from an external device, such as a personal computer or a word processor, via a printer cable, and for printing onto a sheet an image corresponding to the received image data.

As shown in FIG. 3A, the laser printer 1 includes: a sheet supply unit 2, a developing unit 3, a fixing unit 4, and a scanner unit 5. The sheet supply unit 2 is for supplying sheets P for printing. The scanner unit 5 is for irradiating a photosensitive drum 30, provided in the developing unit 3, with a laser beam based on image data, thereby forming an electrostatic latent image. The developing unit 3 is for developing the electrostatic latent image into a toner visible image and for transferring the toner visible image from the photosensitive drum 30 to a sheet P supplied from the sheet supply unit 2. The fixing unit 4 is for fixing the toner image on the sheet P.

The paper supply unit 2 includes: a feeder case 20, a paper supply roller 23, a separation pad 24, and a pair of registration rollers 10, 11. The registration roller 10 is provided above the other registration roller 11. The paper supply roller 23 rotates when driven by a power source (not shown in the drawings). A support plate 22 and a spring 21 are included in the feeder case 20. The spring 21 presses against the support plate 22. Sheets P are stacked on the support plate 22 within the feeder case 20. The support plate 22 is urged by the spring 21 in a direction toward the paper supply roller 23. Accordingly, the leading edge of the sheets P are pressed against the paper supply roller 23. The rotating paper supply roller 23 and the separation pad 24 separate one uppermost sheet P from the stack at a time, and supplies the sheet P to the pair of registration rollers 10, 11. A manual-insertion opening 25 is opened in the sheet supply unit 2 to receive a manually-inserted sheet P. The manual-insertion opening 25 is oriented at an angle to the vertical direction. By inserting a desired sheet P through the manual-insertion opening 25, it is possible to print on the desired sheet P that is different from those stacked within the feeder unit case 20.

The scanning unit 5 includes: a laser (not shown in the drawings) for emitting laser light, a polygon mirror 50, a plurality of lenses 52, and a plurality of reflecting mirrors 51, 51. A laser beam L emitted from the laser irradiates the outer surface of the photosensitive drum 30 via the polygon mirror 50, the lenses 52, and the reflecting mirrors 51, thereby forming an electrostatic latent image on the photosensitive drum 30.

The developing unit 3 is in a process cartridge shape and is detachably mounted in the laser printer 1. The developing unit 3 includes: the photosensitive drum 30; a developing roller 31; a supply roller 32; a toner tank 33; a layer-thickness regulating blade 34; a transfer roller 35, a charge unit 36; a cleaning roller 37; and a toner sensor 39.

The photosensitive drum 30 includes a cylindrical sleeve and a photoconductive layer provided on the outer surface of the cylindrical sleeve. The cylindrical sleeve is made from aluminum. The photoconductive layer is formed from a phthalocyanine OPC (Organic Photo Conductor). Phthalocyanine OPC is an organic semiconductor, and conducts electricity when irradiated with light. The cylindrical sleeve is electrically grounded.

The charge unit 36 is disposed below the photosensitive drum 30. The charge unit 36 is a positively charging scorotoron charger, and includes a grid electrode and a charge wire. The charge wire is made from tungsten, for example, and generates a corona discharge. The charge unit 36 electrifies the photosensitive drum 30 to establish a positive electric potential on the surface of the photosensitive drum 30.

The transfer roller 35 is disposed above the photosensitive drum 30 in contact with the surface of the photosensitive drum 30. Sheets P are transported between the transfer roller 35 and the photosensitive drum 30. The transfer roller 35 is applied with a transfer bias voltage whose polarity is opposite to the polarity of the potential of the photosensitive drum 30.

The cleaning roller 37 is for cleaning the surface of the photosensitive drum 30. The cleaning roller 37 is disposed downstream from the photosensitive drum 30 in the sheet conveying direction.

It is noted that a discharge lamp 38 is provided at a position between the developing unit 3 and the fixing unit 4. The discharge lamp 38 is for discharging the surface of the photosensitive drum 30.

The toner tank 33, the supply roller 32, the developing roller 31, and the photosensitive drum 30 are disposed in the sheet supply direction so that the toner tank 33 is disposed upstream from the supply roller 32, the supply roller 32 is disposed upstream from the developing roller 31, and the developing roller 31 is disposed upstream from the photosensitive drum 30.

The toner tank 33 stores therein polymer toner. The toner sensor 39 is provided within the toner tank 33. The toner sensor 39 projects upwards in the toner tank 33, and detects the presence or absence of polymer toner in the toner tank 33.

The polymer toner is made from pigment, resin, charge control agent, and wax. The pigment is a well-known pigment, such as carbon black. The resin is a styrene-acrylic type resin, and is for fixing the pigment to the sheets. The charge control agent is made from nigrosine, triphenylmethane, quaternary ammonium salt, or the like. Core particles are first prepared from the pigment, the charge control agent, and the wax. Then, main particles of approximately spherical shape with an average diameter of 9 μm are prepared by chemically synthesizing the resin and the core particles using a suspension polymerization method. Toner particles can be prepared by adding some external additives to the main particles. Alternatively, toner particles can be prepared from the main particles as they are. Because the thus prepared polymer toner has spherical shape, this toner has high fluidity and does not occur fogging of the type that will be occurred by the pulverized toner. When the polymer toner is heated by a heat roller 40 to be described later, the resin melts and the wax contained inside the toner particles also melts and flows out and fixes the toner to the sheet.

The supply roller 32 is made from resin sponge and formed into a cylindrical shape. The developing roller 31 includes: a cylindrically-shaped base member; and a coating layer provided on the outer surface of the base member. The cylindrically-shaped base member is made from silicone rubber. The coating layer is made from resin or rubber material. The coating layer contains minute carbon particles. The coating layer contains fluorine on its outer surface. It is noted, however, that the base member of the developing roller 31 does not have to be made from silicone rubber, but may be made from other material, such as urethane rubber.

The photosensitive drum 30, the developing roller 31, the supply roller 32, and the toner tank 33 are disposed in contact with one another. The supply roller 32 supplies polymer toner, supplied from the toner tank 33, to the developing roller 31 at a supply point A, where the supply roller 32 and the developing roller 31 contact with each other. The developing roller 31 supplies polymer toner to the photosensitive drum 30 at another supply point B, where the developing roller 31 contacts the photosensitive drum 30.

Figure 3B:
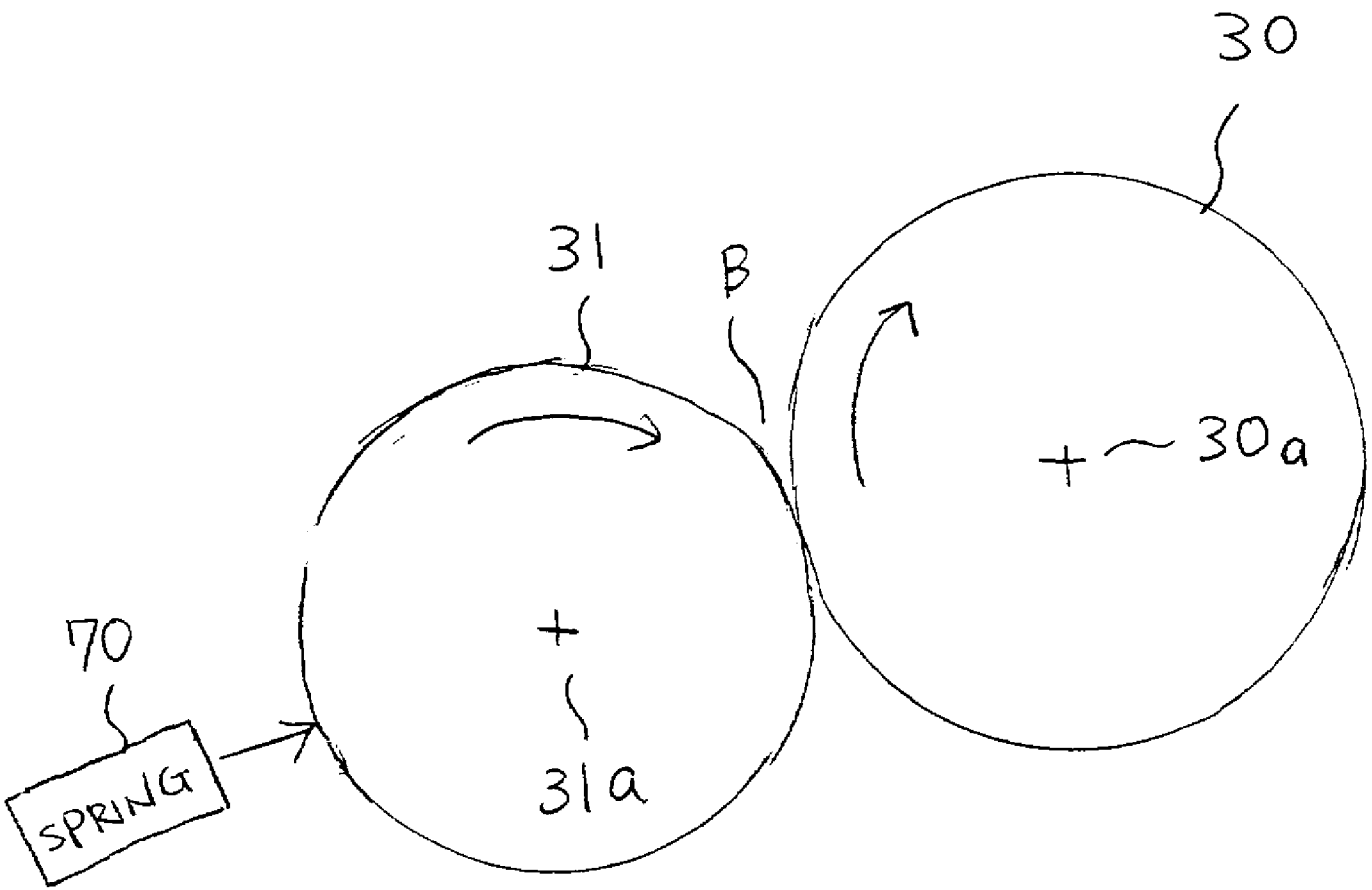
FIG. 3B is a schematic view illustrating how a developing roller is pressed against a photosensitive drum in the laser printer of FIG. 3A.

As shown in FIG. 3B, a rotational axis 30*a* of the photosensitive drum 30 is rotatably supported by a pair of opposite side walls (not shown) of the process cartridge (developing unit) 3 so that the photosensitive drum 30 can rotate about its rotational axis 30*a*. Similarly, a rotational axis 31*a* of the developing roller 31 is rotatably supported by the side walls of the process cartridge 3 so that the developing roller 31 can rotate about its rotational axis 31*a*. Both ends of the rotational axis 31*a* are rotatably held in a pair of through-holes, which are formed in the opposite side walls of the process cartridge 3. A spring 70 is mounted in the process cartridge 3. Although not shown in the drawing, an engaging member is mounted in the laser printer 1 at such a position that the engaging member engages with the spring 70 when the process cartridge 3 is mounted in the laser printer 1. When the engaging member engages with the spring 70, the engaging member causes the spring 70 to urge the rotational axis 31*a* in a direction toward the rotational axis 30*a* as shown in FIG. 3B. It is noted that the pair of through-holes in the process cartridge side walls are elongated in a direction toward the rotational axis 30*a*. Accordingly, the outer surface of the developing roller 31 is pressed against the outer surface of the photosensitive drum 30 with a pressing force whose amount is determined dependently on the characteristics of the spring 70 and on the distance between the original positions of the rotational axes 31*a* and 30*a*. It is noted that the spring 70 may be mounted in the laser printer 1 side and the engaging member may be mounted in the process cartridge 3 side so that when the process cartridge 3 is mounted in the laser printer 1, the engaging member will engage with the spring 70 to cause the spring 70 to urge the rotational axis 31*a* toward the rotational axis 30*a*. The spring 70 may be configured to urge the rotational axis 30*a* toward the rotational axis 31*a*.

It is noted that in the case where the spring 70 is provided in the process cartridge 3, the spring 70, the photosensitive drum 30, and the developing roller 31 may be positioned in the process cartridge 3 in such locations that the spring 30 always urges the rotational axis 31*a* and the rotational axis 30*a* toward each other as shown in FIG. 3B regardless of whether or not the process cartridge 3 is mounted in the laser printer 1. In this case, it is unnecessary to provide the engaging member in the laser printer 1 or the process cartridge 3.

As shown in FIG. 3A, the photosensitive drum 30, the developing roller 31, and the supply roller 32 each rotates in the clockwise direction. Polymer toner supplied from the toner tank 33 is transported from the supply roller 32 to the photosensitive drum 30, passing over the upper sides of the supply roller 32 and the developing roller 31.

The developing unit 3 employs the opposite-direction developing method. That is, the photosensitive drum 30 and the developing roller 31 rotate in the same clockwise direction while contacting each other. Accordingly, an electrostatic latent image on the photosensitive drum 30 is developed at the polymer toner supply point B, at which the surfaces of the photosensitive drum 30 and the developing roller 31 are contacting with each other while moving in opposite directions from each other.

The layer-thickness regulating blade 34 is for controlling the thickness of the layer of polymer toner on the developing roller 31. The layer-thickness regulating blade 34 is made by bending a stainless steel (SUS) leaf spring. The layer-thickness regulating blade 34 reduces the polymer toner on the developing roller 31 to a uniform thickness. The layer-thickness regulating blade 34 is disposed above the supply point A. In other words, the layer-thickness regulating blade 34 is disposed downstream from the supply point A in the direction of rotation of the supply roller 31. Accordingly, the polymer toner removed by the layer thickness regulating blade 34 is again supplied to the supply point A. In this way, it is possible to supply polymer toner to the supply point A efficiently. The electrostatic latent image formed on the photosensitive drum 30 is developed by the polymer toner that has been reduced to a uniform thickness by the layer-thickness regulating blade 34 on the developing roller 31. In this way, the latent image on the photosensitive drum 30 is uniformly developed.

The fixing unit 4 includes: the heat roller 40, a pressure roller 41, and a pair of sheet discharge rollers 12, 13. The pair of sheet discharge rollers 12, 13 are disposed downstream from the rollers 40 and 41.

With the above-described configuration, the laser printer 1 of the present embodiment performs printing operation as described below.

First, the charge unit 36 produces an electrically-charged layer on the outer surface of the photosensitive drum 30.

Next, the scanner unit 5 scans the charged layer with a laser beam L that has been modulated in accordance with image data. As a result, an electrostatic latent image is formed on the surface of the photosensitive drum 30.

The supply roller 32 and the developing roller 31 both rotate in the clockwise direction. The supply roller 32 receives the supply of polymer toner from the toner tank 33. At the supply point A, the polymer toner becomes positively charged due to friction between the polymer toner and the supply roller 32 and the developing roller 31, and adheres to the surface of the developing roller 31 due to the image force.

The excess amount of polymer toner adhering to the surface of the developing roller 31 is removed by the layer-thickness regulating blade 34. The charge on the polymer toner remaining on the developing roller 31 is further increased by the layer-thickness regulating blade 34, and is transferred to the surface of the photosensitive drum 30. As a result, the electrostatic latent image on the photosensitive drum 30 is developed by the polymer toner. According to the transfer bias applied to the transfer roller 35, the developed toner image is transferred onto the sheet P when the sheet P passes between the transfer roller 35 and the photosensitive drum 30. The fixing unit 4 fixes the toner image onto the sheet P by heating the sheet P while the sheet P passes between the heat roller 40 and the pressure roller 41. The toner image-fixed sheet P is discharged by the sheet discharge rollers 12, 13 onto a discharge tray (not shown) provided to the laser printer 1.

After the toner image is transferred to the sheet P, the charge remaining on the surface of the photosensitive drum 30 is removed by the discharge lamp 38. Then, the polymer toner remaining on the surface of the photosensitive drum 30 is temporarily collected by the cleaning roller 37. The collected polymer toner is returned to the photosensitive drum 30 at a predetermined timing, and is recycled by the developing roller 31.

Next will be described in greater detail how the electrostatic latent image is developed by polymer toner by the photosensitive drum 30 and the developing roller 31.

Figure 4:
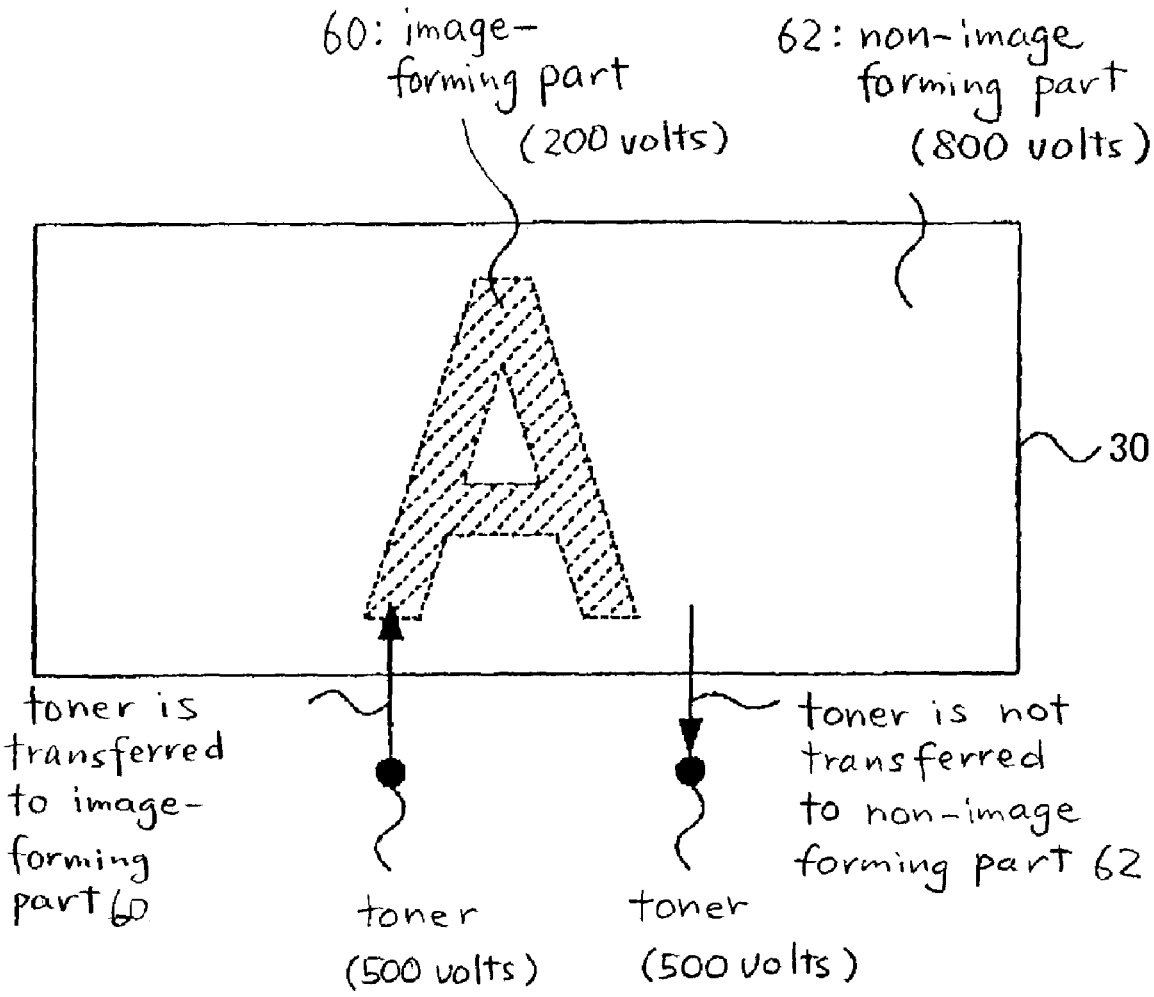
FIG. 4 is a diagram illustrating how an electrostatic latent image is developed with toner on the photosensitive drum.

When the surface of the photosensitive drum 30 (OPC) is uniformly charged by the charge unit 36, the surface of the photosensitive drum 30 (OPC) is electrically charged to as high as about +800 volts. When it is desired to form an image of letter "A", as shown in FIG. 4, laser light is emitted from the scanner unit 5 to strike the part 60 of the photosensitive drum 30 in the shape of letter "A", thereby forming an electrostatic latent image. The part 60 will be referred to as an "image forming part" hereinafter. The other remaining part 62 that is irradiated with no light will be referred to as a "non-image forming part" hereinafter. As a result, the electric charge is removed from the image forming part 60 through the OPC and the cylindrical sleeve, and the potential on the image forming part 60 drops to as low as about +200 volts.

According to the present embodiment, the electrostatic latent image formed in this way is developed by using a predetermined reversal developing method, so that polymer toner is applied to the image forming region 60 that has lost the electric charge.

The developing roller 31 is applied with a voltage of around +500 volts. Accordingly, the potential of the developing roller 31 is intermediate between the potential of the image forming part 60 that has lost the charge 60 and the non-image forming part 62 that has lost no charge. The electrically-charged polymer toner is transported by the developing roller 31 to the supply point B, where the roller 31 comes into contact with the photosensitive drum 30. The polymer toner is electrostatically attracted toward the image forming part 60 due to the potential difference between the developing roller 31 and the image forming part 60, and is transferred onto the image forming part 60. However, polymer toner is electrostatically repelled by the non-image forming part 62 that has lost no charge, and therefore the polymer toner is not transferred to the non-image forming part 62. As a result, only the image forming part 60 is developed by polymer toner. In other words, the charged toner is transferred to the image forming part 60 because the potential (500V) of the developing roller 31 is greater than the potential (200 V) of the image forming part 60, but the charged toner is not transferred to the non-image forming part 62 because the potential (500V) of the developing roller 31 is smaller than the potential (800 V) of the non-image forming part 62.

In this way, the electrostatic latent image is developed by using the potential difference (300 volts) between the developing roller 31 (500 volts) and the image forming part 60 (200 volts) and by using the potential difference (300 volts) between the developing roller 31 and the non-image forming part 62 (800 volts). It is noted, however, that in practice some variation occurs in the potential differences, and the potential differences vary in a range of 200 volts and 400 volts. When the potential difference between the developing roller 31 and the non-image forming part 62 becomes smaller than 300 volts, this decreases the repulsive force of repelling toner on the developing roller 31 to prevent the toner from being transferred to the photosensitive drum 30. This results in that the toner adheres to the non-image forming part 62 where the polymer toner should not be adhered. The non-image forming part 62 therefore will not appear white but will appear slightly gray due to a small amount of toner adhering to the non-image forming part 62. This results in fogging.

As will be described later, experiments were executed to examine the cause of this type of fogging. The results showed that this kind of fogging (hereafter called "pressure fogging") can be prevented by controlling the pressing force that acts between the developing roller 31 and the photosensitive drum 30.

According to the present embodiment, therefore, in order to prevent occurrence of the pressure fogging, the pressure between the photosensitive drum 30 and the developing roller 31 is set to 0.24 MPa (mega-pascals). More specifically, the force of the spring 70 and the distance between the original positions of the rotational axes 31*a* and 30*a* (FIG. 3B) are adjusted so that the spring 70 presses the developing roller 31 against the photosensitive drum 30 with a contact pressure of 0.24 MPa. It was proved by the measurements that pressure fogging can be prevented under practical operating environments by setting to 0.24 MPa the pressure between the photosensitive drum 30 and the developing roller 31.

The measurement method and measurement results will be described below.

The surface of the photosensitive drum 30 was uniformly charged to a voltage of 800 volts. Printing of a blank white image was performed repeatedly while changing the amount of the voltage applied to the developing roller 31 and the amount of the pressure applied between the photosensitive drum 30 and the developing roller 31. A printed sheet P was obtained when one blank-white image printing operation was performed for a combination of each one voltage amount of the developing roller 31 and each pressure amount between the photosensitive drum 30 and the developing roller 31. A plurality of printed sheets P were obtained by executing the blank-white image printing operations a plurality of times while changing the voltage amount of the developing roller 31 and the pressure amount between the photosensitive drum 30 and the developing roller 31. The reflectivity (reflectance) of each printed sheet P was measured using a reflectometer (Tokyo Denshoku Co., Ltd model TC-6MC) and a green (G) filter. It is noted that the original reflectivity of the sheets P, which were not yet subjected to the printing operation, was also measured. The blank-white image printing was executed by controlling the scanner unit 5 to irradiate no light on the entire surface of the photosensitive drum 30, thereby forming only the non-image forming part 62 on the photosensitive drum 30. The amount of the voltage applied to the developing roller 31 was varied so that the potential difference between the surface of the photosensitive drum 30 (non-image forming part 62) and the developing roller 31 varied in the range of 0 volts to 400 volts. The pressure between the photosensitive drum 30 and the developing roller 31 was set among a plurality of values of 0.22 MPa, 0.24 MPa, 0.31 MPa, and 0.55 MPa.

Figure 5:
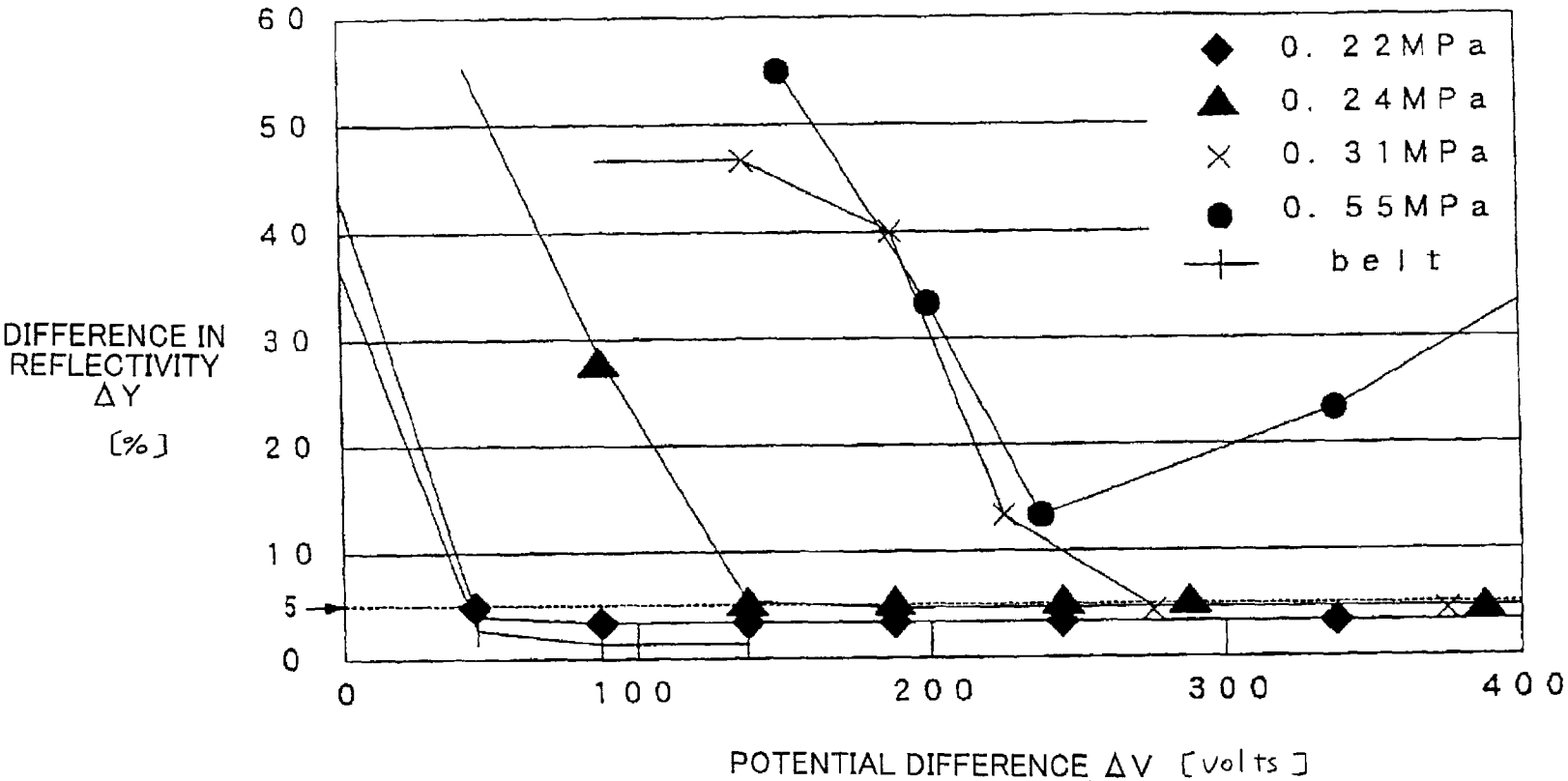
FIG. 5 is a graph showing the results of an experiment executed for the first embodiment.

A graph of FIG. 5 was plotted based on results of the measurements. The horizontal axis of FIG. 5 is the potential difference $\Delta V$ between the potential of the surface of the photosensitive drum 30 (potential of the non-image forming part 62) and the potential of the developing roller 31. The vertical axis of the graph of FIG. 5 shows the difference in reflectivity $\Delta Y$ % of the sheet P before and after printing. In other words, the difference in reflectivity $\Delta Y$ % is a difference between the original reflectivity of the sheet P and the reflectivity of the sheet P after the sheet P is subjected to the blank-white image printing. It is noted that when the difference in reflectivity ΔY % on the vertical axis has a value of greater than 5, it is known that pressure fogging occurs on the printed sheet P.

As is clear from FIG. 5, when the developing roller 31 and the photosensitive drum 30 are pressed against each other with a pressing force of greater than 0.31 MPa, even when the potential difference ΔV between the photosensitive drum 30 and the developing roller 31 is at the proper value (300 volts), the difference in reflectivity ΔY becomes greater than 10, and pressure fogging occurs.

In contrast to this, when the developing roller 31 and the photosensitive drum 30 are pressed against each other with a pressing force of 0.31 Mpa, if the potential difference ΔV between the photosensitive drum 30 and the developing roller 31 is around the proper value of 300 volts, pressure fogging does not occur, and therefore satisfactory printing result is obtained.

When the developing roller 31 and the photosensitive drum 30 are pressed against each other with a pressing force of 0.24 MPa, if the potential difference ΔV between the photosensitive drum 30 and the developing roller 31 is within the range of practical variation of about 200 volts to about 400 volts, no pressure fogging occurs, and therefore satisfactory printing result is obtained.

Furthermore, when the developing roller 31 and the photosensitive drum 30 are pressed against each other with a pressing force 0.22 MPa, no pressure fogging occurs and satisfactory printing result is obtained if the potential difference ΔV between the photosensitive drum 30 and the developing roller 31 is within a range of about 100 volts to about 400 volts. In this way, by setting the pressure between the developing roller 31 and the photosensitive drum 30 to 0.22 MPa, no pressure fogging occurs not only when the potential difference ΔV is within the practical variation range of 200 volts to 400 volts but also exceeds the practical variation range and is in the range of 100 volts to 200 volts.

In this way, the measurements proved that even though the opposite-direction developing method is employed with polymer toner, high quality printing with no pressure fogging can be attained by setting the pressure between the photosensitive drum 30 and the developing roller 31 to appropriate values. More specifically, by setting the pressure to be 0.31 MPa or less, good printing can be obtained when the potential difference between the photosensitive drum 30 and the developing roller 31 is ideally fixed to about 300 volts. Good printing can be obtained by setting the pressure to 0.24 MPa or less for operations within the practical operating environments where the potential difference varies within a practical range of about 200 volts and about 400 volts. Good printing can still be obtained by setting the pressure to 0.22 MPa or less for more even severe operating environments where the potential difference varies exceeding the practical range of about 200 volts and about 400 volts but varies with a range of about 100 volts and about 400 volts.

It is possible to prevent occurrence of pressure fogging if the pressure between the developing roller 31 and the photosensitive drum 30 is 0.31 MPa or less, even when polymer toner is used and the developing roller 31 and the photosensitive drum 30 are moving in opposite directions at the point B where they contact with each other according to the opposite-direction developing method.

Therefore, in the laser printer 1 employing the opposite-direction developing method, by setting the pressure between the photosensitive drum 30 and the developing roller 31 to 0.31 MPa or less, the occurrence of pressure fogging can be prevented. The lower limit for the pressure is such a value at which the electrostatic latent image can be developed. The value of the lower limit can be set to suit each different type of apparatus.

From the test results, it was found that if the pressure is 0.31 MPa or less, then pressure fogging does not occur when the potential difference ΔV is at the proper value (300 volts). Therefore, by setting the pressure between the photosensitive drum 30 and the developing roller 31 to 0.31 MPa or less, pressure fogging will be prevented when the voltage difference is at the proper value.

Also, when the pressure is 0.24 MPa or less, then even if there is variation in the potential difference ΔV, pressure fogging does not occur. Therefore, by setting the pressure between the photosensitive drum 30 and the developing roller 31 to 0.24 MPa or less, pressure fogging will be prevented when the voltage difference is within the range that occurs in practice.

Still more preferably, by setting the pressure between the photosensitive drum 30 and the developing roller 31 to 0.22 MPa or less, pressure fogging will be prevented even when the voltage difference is in a range broader than the range that occurs in practice.

As described above, according to the present embodiment, the pressure between the developing roller 31 and the photosensitive drum 30 is set to 0.24 MPa. Because the pressure is smaller than 0.31 MPa, if the potential difference ΔV between the non-image forming part 62 on the photosensitive drum 30 and the electrically-charged polymer toner on the surface of the developing roller 31 is at the preset proper voltage (300 volts), pressure fogging will be prevented. Because the pressure is 0.24 MPa or less, even if the potential difference varies within the range of 200 volts to 400 volts that occurs in practice, pressure fogging will be prevented. By resetting the pressure to 0.22 MPa, even if the potential difference ΔV varies in a wider voltage range of 100 to 400 volts, pressure fogging will be prevented. In this way, by setting the pressure between the developing roller 31 and the photosensitive drum 30 appropriately, pressure fogging can be prevented even when using the opposite-direction developing method and polymer toner.

According to the present embodiment, the laser printer 1 includes: the scanner unit 5 scanning the photosensitive drum 30 to form an electrostatic latent image; the transfer unit 35 transferring the developed toner image from the photosensitive drum 30 to the recording medium P; and the fixing unit 4 fixing the toner image onto the recording medium P. Because pressure fogging does not occur, good quality printing on the recording medium P will be attained.

In the above description, the layer-thickness regulating blade 34 is made by bending a stainless steel (SUS) leaf spring. However, the layer-thickness regulating blade 34 can be made in other various ways. For example, the layer-thickness regulating blade 34 can be made by providing a leaf spring with a soft resilient member such as silicone rubber.

Second Embodiment

Next, a color laser printer 101 according to a second embodiment will be described with reference to FIGS. 6-10B.

The color laser printer 101 includes a main casing 103. The color laser printer 101 has, in the main casing 103, a sheet supply unit 107 for supplying a sheet of paper P as a recording medium; and an image forming unit 109 for forming a desired image on the supplied paper P.

The sheet supply unit 107 includes: a sheet supply tray 111, in which sheets P are stacked; and a sheet-supply roller 113 that presses on the uppermost sheet P of the stack in the sheet supply tray 111. Rotation of the sheet-supply roller 113 pulls one sheet P at a time from the top of the stack, and transports the same to a pair of feed rollers 115, further to a pair of registration rollers 117, and further to an image forming location.

The image forming location is a place where a toner image, formed on an intermediate transfer belt 151 (to be described later), is transferred onto the sheet P. In the present embodiment, the image forming location is defined as a place where the intermediate transfer belt 151 is in contact with a transfer roller 127 (to be described later).

The image forming unit 109 includes: a scanner unit 121; a process unit 123; an intermediate transfer belt mechanism 125; the transfer roller 127; and a fixing unit 129. The process unit 123 includes: a photosensitive belt mechanism 131, and a plurality (four) of developing cartridges 135 (135Y, 135M, 135C, and 135K).

The photosensitive belt mechanism 131 is disposed substantially at the center of the casing 103. The photosensitive belt mechanism 131 includes: a first photosensitive belt roller 139; a second photosensitive belt roller 141; a third photosensitive belt roller 143; a photosensitive belt 133; a photosensitive belt charging unit 145; a voltage application unit 147; and a potential control unit 149.

In the photosensitive belt mechanism 131, the first, second, and third photosensitive belt rollers 139, 141, and 143 are arranged in a triangular configuration. The photosensitive belt 133 is wound around the first, second, and third photosensitive belt rollers 139, 141, and 143. The second photosensitive belt roller 141 is a roller that is driven to rotate by a main motor (not shown in the drawings). The first photosensitive belt roller 139 is disposed vertically below the second photosensitive belt roller 141. The third photosensitive belt roller 143 is disposed above and in front of the first photosensitive belt roller 139. When the second photosensitive belt roller 141 is driven by the main motor (not shown) to rotate in a counterclockwise direction, the photosensitive belt 133 rotates in the counterclockwise direction, with the first and third photosensitive belt rollers 139 and 143 rotating by following the rotation of the second photosensitive belt roller 141.

Figure 7A:
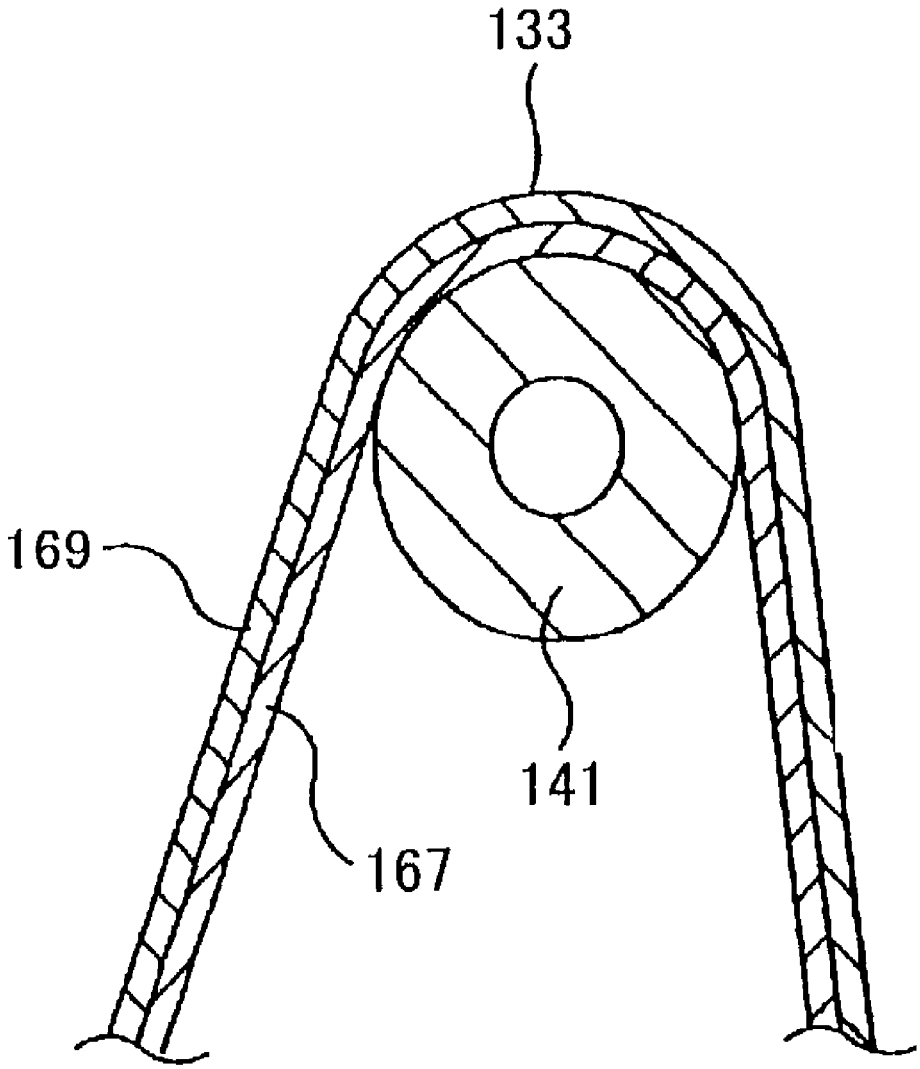
FIG. 7A is a schematic cross-sectional view showing a cross-section taken through a photosensitive belt of the second embodiment along its lengthwise direction.

The photosensitive belt 133 is an endless belt. As shown in FIG. 7A, the photosensitive belt 133 includes: a base layer 167; and a photosensitive layer 169 provided over an outer surface of the base layer 167. The base layer 167 has a thickness of 0.15 mm. The photosensitive layer 169 has a thickness of 25 μm. The photosensitive layer 169 is made from a polycarbonate type resin photosensitive material.

The base layer 167 is made from polyethylene type resin containing electrically-conductive material such as carbon or ionic conductive agent. The base layer 167 is electrically conductive. That is, the base layer 167 has a volume resistivity of $1\times10^5$ Ω·cm (ohms-cm), and has a surface resistance of $1\times10^5$ Ω/□ (ohms/square). The base layer 167 has a ten-point average roughness Rz of 1 μm on its outer surface, on which the photosensitive layer 169 is provided.

Figure 7B:
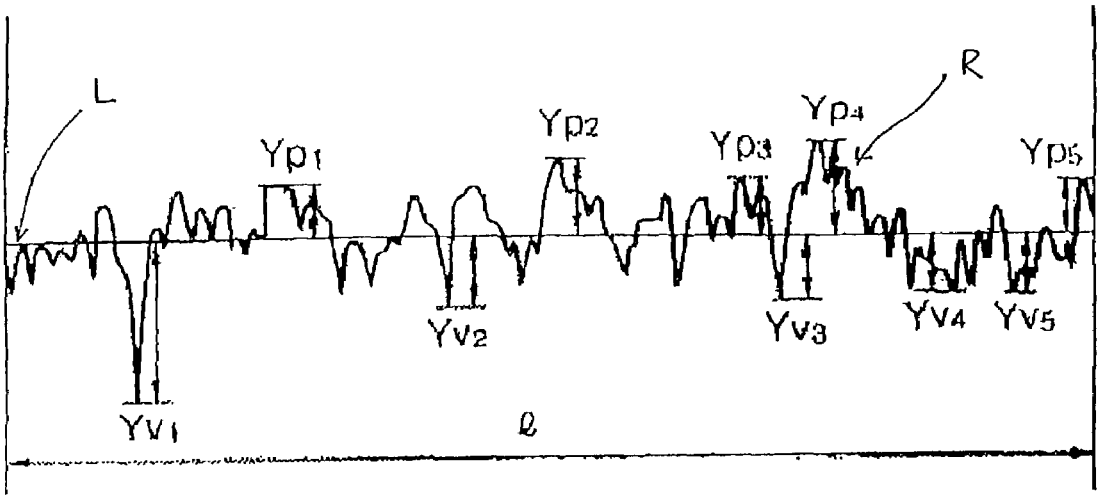
FIG. 7B illustrates the definition of a ten-point average surface roughness Rz.

The ten-point average roughness Rz is defined as described below:

As shown in FIG. 7B, a roughness line R is defined to indicate the heights of each position on the surface of the base layer 167. An average line L is also defined indicative of the average height of all the points on the surface of the base layer 167. A part of the roughness line R having a reference length ι is extracted from the entire roughness line R as shown in FIG. 7B. The ten-point average roughness Rz is defined by a sum of: a first average of the absolute values of the heights Yp1, Yp2, Yp3, Yp4, and Yp5 of the first through fifth highest peaks relative to the average line L; and a second average of the absolute values of the depths Yv1, Yv2, Yv3, Yv4, and Yv5 of the first through fifth deepest valleys relative to the average line L. In other words, the ten-point average roughness Rz is defined by the following equation:

$$Rz=\{|Yp1+Yp2+Yp3+Yp4+Yp5|+|Yv1+Yv2+Yv3+Yv4+Yv5|\}/5.$$

Figure 6:
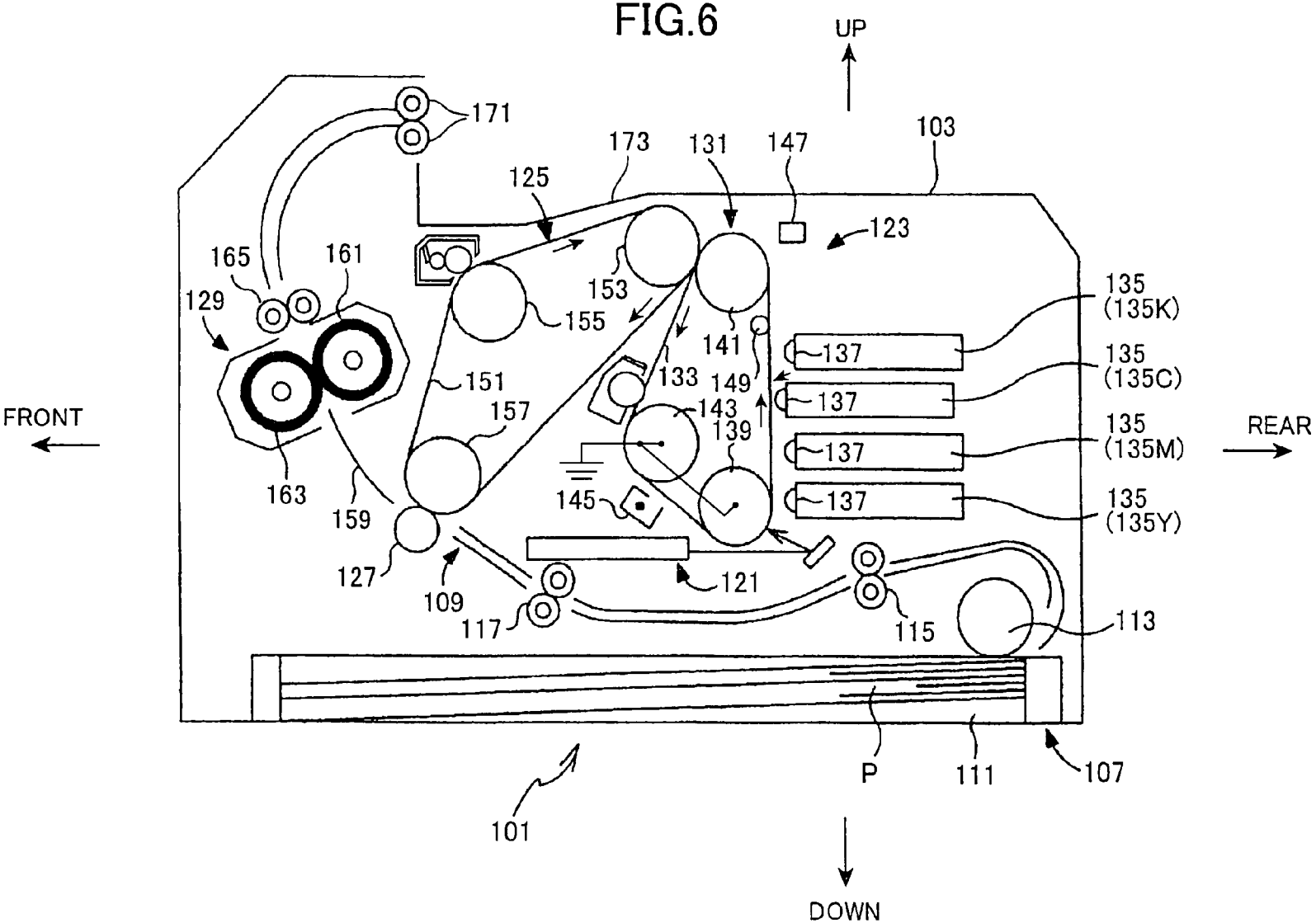
FIG. 6 is a schematic view showing a color laser printer according to a second embodiment of the present invention.

As shown in FIG. 6, the photosensitive belt charging unit 145 is disposed below the third photosensitive belt roller 143 and the photosensitive belt 133. The photosensitive belt charging unit 145 is disposed at a position that is near to the first photosensitive belt roller 139 and that is upstream, in the moving direction of the belt 133, from the position where the photosensitive belt 133 is irradiated by the scanner unit 121. The photosensitive belt charging unit 145 is disposed in substantial confrontation to the photosensitive belt 133 and is separated from the photosensitive belt 133 by a predetermined distance. The photosensitive belt charging unit 145 includes: a power source, and a scorotoron type charge unit. The scorotoron type charge unit has a charge wire made from tungsten, for example, that uses the power supplied from the power source to generate a corona discharge and to charge or electrify the surface of the photosensitive belt 133 to a uniform positive charge. As a result, a predetermined electric potential (+800 volts, for example) is established on the photosensitive layer 169 in the same manner as in the first embodiment.

A voltage application unit 147 is provided at a position near to the second photosensitive belt roller 141. The voltage application unit 147 applies a predetermined electric voltage of about +300 volts, for example, to the second photosensitive belt roller 141 using the power source of the photosensitive belt charging unit 145. More specifically, the voltage application unit 147 is electrically connected to the power source of the photosensitive belt charging unit 145, and applies the electric voltage of +300 volts to the second photosensitive belt roller 141, such that the voltage application unit 147 and the second photosensitive belt roller 141 constitute an electric potential establishing unit.

Each of the first and third photosensitive belt rollers 139 and 143 is made from an electrically conductive material, aluminum, for example. The outer circumferential surfaces of the first and third photosensitive belt rollers 139 and 143 are in contact with the base layer 167. The first and third photosensitive belt rollers 139 and 143 are also in contact with a ground (GND) terminal, as shown in FIG. 6. In other words, the first photosensitive belt roller 139 and the third photosensitive belt roller 143 serve as electric-energy (electric-charge) feeding units to maintain, at the ground voltage, the parts of the base layer 167 of the photosensitive belt 133 that are in contact with the rollers 139 and 143. More specifically, while the charging unit 145 charges the outer surface of the photosensitive layer 169 and the scanner unit 121 irradiates light onto the outer surface of the photosensitive layer 169 to remove charge selectively from the outer surface of the photosensitive layer 169, the rollers 139 and 143 supply electrical charge, whose amount corresponds to the charge established on the outer surface of the photosensitive layer 169, to the inner surface of the photosensitive layer 169 via the electrically-conductive base layer 167.

The potential control unit 149 is disposed at a position between the second photosensitive belt roller 141 and the first photosensitive belt roller 139 and higher than a black developing cartridge 135K to be described later. The potential control unit 149 is a rotatable roller electrode, for example, that is in contact with the base layer 167 of the photosensitive belt 133 and that is also in contact with a ground (GND) terminal (not shown in the drawings). The potential control unit 149 causes the potential of the base layer 167 to drop to the ground voltage at the position where the base layer 167 is in contact with the potential control unit 149.

The scanner unit 121 is disposed below the photosensitive belt mechanism 131. Although not shown in the drawings, the scanner unit 21 includes: a laser emitting unit, a polygon mirror, a plurality of lenses, and a reflection mirror. In the scanner unit 121, the laser emitting unit is modulated based on image data for a corresponding color component (cyan, magenta, yellow, or black) of an original image to emit the modulated laser light. The laser light is reflected at the polygon mirror, passes through the plurality of lenses, and is reflected at the reflection mirror. The laser light finally irradiates in a high speed scan the surface of the photosensitive belt 133, thereby forming, on the photosensitive belt 133, an electrostatic latent image for the corresponding color component of the original image. More specifically, charge is removed from the irradiated part (image forming part) of the photosensitive belt 133 and the electric potential of the image forming part decreases to about +200 volts, while the potential of the non-irradiated part (non-image forming part) is maintained at about +800 volts in the same manner as in the first embodiment.

Each of the four developing cartridges 135 is for developing the electrostatic latent image for a corresponding color component, which is formed on the photosensitive belt 133, into a corresponding color visible image. The four developing cartridges 135 store polymer toner as a developing agent. More specifically, the four developing cartridges 135Y, 135M, 135C, and 135K store polymer toner of yellow, magenta, cyan, and black, respectively. The polymer toner is made by the suspension polymerization method similarly to the first embodiment. The developing cartridges 135Y, 135M, 135C, and 135K are aligned vertically from bottom to top in this order, and are separated from one another by a predetermined distance.

The developing cartridges 135 are disposed at the rear of the photosensitive belt mechanism 131 in the casing 103 so that the second photosensitive belt roller 141 is disposed at a location higher than the black developing cartridge 135K, which is at the highest position in the stack of developing cartridges 135, and so that the first photosensitive belt roller 139 is positioned lower than the yellow developing cartridge 135Y, which is at the lowest position in the stack of developing cartridges.

Each developing cartridge 135 includes a developing roller 137. The developing roller 137 is provided at the front end of each developing cartridge 135. The developing cartridges 135 are configured so as to be driven by a solenoid mechanism (not shown in the drawings) to move independently from one another in order to bring their own developing rollers 137 into and out of contact with the photosensitive belt 133. Although not shown in the drawings, the color laser printer 101 includes a control device. The control device controls the solenoid mechanism to bring the developing roller 137 of each toner cartridge 135 into and out of contact with the photosensitive belt 133.

The developing roller 137 includes a metal roller shaft covered by a roller. The roller is made from an electrically conductive resilient rubber material. More specifically, the roller has a two-layer structure, and includes a roller portion and a coating applied on the outer surface of the roller portion. The roller portion is made of electrically-conductive resilient material, such as urethane rubber, silicone rubber, or EPDM rubber, that contains fine carbon particles. The coating is made mainly from urethane rubber, urethane resin, polyimide resin, or the like. A predetermined developing bias voltage is applied to the developing roller 137 with respect to the photosensitive belt 133. In this example, the developing roller 137 is applied with a voltage of +500 volts, while the photosensitive belt 133 has an electric potential of +800 volts at its non-image forming part and an electric potential of +200 volts at its image forming part in the same manner as in the first embodiment. Accordingly, similarly to the first embodiment, the potential difference $\Delta V$ between the developing roller 137 and the non-image forming part of the photosensitive layer 169 is ideally 300 volts, but normally varies in a range of 200 volts to 400 volts in practical operating conditions.

Although not shown in the drawings, each developing cartridge 135 further includes: a layer thickness regulating blade; a supply roller; and a toner storing portion. The toner storing portion stores therein positively-charging non-magnetic single component spherical-shaped polymer toner of a corresponding color (yellow, magenta, cyan, or black). The toner is supplied to the developing roller 137 by rotation of the supply roller. The toner becomes positively charged by friction between the toner and the supply roller and the developing roller 137. The toner supplied to the developing roller 137 passes between the developing roller 137 and the layer-thickness regulating blade, where the toner is further charged by friction. As a result, a uniform thickness of sufficiently-charged toner is formed on the developing roller 137.

The developing roller 137 is configured to rotate in a counterclockwise direction. Accordingly, when the developing roller 137 is in contact with the photosensitive belt 133, the developing roller 137 and the photosensitive belt 133 move in the opposite directions from each other at the portion where they are in contact with each other. Accordingly, the electrostatic latent image on the photosensitive belt 133 is developed by the opposite-direction developing method in the same manner as in the first embodiment.

The intermediate transfer belt mechanism 125 is disposed to the front of the photosensitive belt mechanism 131. The intermediate transfer belt mechanism 125 includes: a first intermediate transfer belt roller 153; a second intermediate transfer belt roller 155; a third intermediate belt transfer belt roller 157; and an intermediate transfer belt 151 wound around the intermediate transfer rollers 153 to 157. The first intermediate transfer belt roller 153 is disposed in substantial confrontation with the second photosensitive belt roller 141 via the photosensitive belt 133 and the intermediate transfer belt 151. The second intermediate transfer belt roller 155 is disposed to the front of and below the first intermediate transfer belt roller 153. The third intermediate transfer belt roller 157 is disposed to the front of and below both the first and second intermediate transfer belt rollers 153 and 155 and is in substantial confrontation with the transfer roller 127 through the intermediate transfer belt 151.

The intermediate transfer belt 151 is an endless belt made from an electrically-conductive resin, such as polycarbonate or polyimide, which is dispersed with conductive particles such as carbon. The first, second, and third intermediate transfer belt rollers 153, 155, and 157 are arranged in a triangular configuration. The intermediate transfer belt is wound around the intermediate transfer rollers 153 to 157. When the first intermediate transfer belt roller 153 is driven by the main motor (not shown in the drawings) to rotate in a clockwise direction, the intermediate transfer belt 151 rotates around the intermediate transfer belt rollers 153 to 157 in a clockwise direction, with the second and third intermediate transfer belt rollers 155 and 157 rotating by following the rotation of the roller 153. The roller 153 is applied with a negative-polarity voltage.

The transfer roller 127 is disposed in substantial confrontation to the third intermediate transfer roller 157 through the intermediate transfer belt 151. The transfer roller 127 includes a metal roller shaft, on which an electrically-conductive rubber roller is mounted. The transfer roller 127 is supported rotatably in the casing 103. The transfer roller 127 is driven by a transfer roller separating mechanism (not shown in the drawings), and is capable of moving between a standby position, where the transfer roller 127 is out of contact with the intermediate transfer belt 151, and a transfer position, where the transfer roller 127 is in contact with the intermediate transfer belt 151. The standby position and the transfer position are defined as confronting with each other with a sheet conveying path 159 being located therebetween. When the transfer roller 127 is in the transfer position, the transfer roller 127 presses, against the intermediate transfer belt 151, a sheet P which is now being conveyed along the sheet conveying path 159.

As will be described later, the transfer roller 127 is in the standby position while color images of the four color components of cyan, magenta, yellow, and black for the original image are being successively formed on the photosensitive belt 133 and are being successively transferred to the intermediate transfer belt 151. When all the four color images have been completely transferred from the photosensitive belt 133 to the intermediate transfer belt 151, a multi-color image (four-color mixed image) is formed on the intermediate transfer belt 151. At this time, the transfer roller 127 moves from the standby position to the transfer position.

When the transfer roller 127 is in the transfer position, the transfer roller 127 is applied with a predetermined transfer bias voltage with respect to the intermediate transfer belt 151. A transfer bias application circuit (not shown in the drawings) applies the transfer bias to the transfer roller 127.

The fixing unit 129 is disposed to the front of the intermediate transfer belt mechanism 125. The fixing unit 129 includes: a thermal roller 161; a pressing roller 163 that presses against the thermal roller 161; and a pair of transport rollers 165 positioned downstream from the thermal roller 161 and the pressing roller 163 in the sheet P conveying direction. The thermal roller 161 has a two-layer structure. That is, the thermal roller 161 includes: an outer layer made of silicone rubber; and an inner layer made of metal. A halogen lamp heater is mounted in the inside of the thermal roller 161.

A pair of discharge rollers 171 are additionally provided to discharge the sheet of paper P, which has been subjected to the image-fixing operation in the fixing unit 129 and which has been transported by the transport rollers 165, onto a discharge tray 173 which is provided on the upper surface of the casing 103.

With the above-described configuration, the color laser printer 101 of the present embodiment operates as described below.

The sheet supply roller 113 presses against the uppermost sheet P in the stack in the sheet supply tray 111. Rotation of the sheet supply roller 113 pulls out one sheet P at a time. The sheet P is transported to the feed rollers 115 and then to the registration rollers 117 and further to the image forming position. The registration rollers 117 execute a predetermined registration operation onto the supplied sheet P.

The photosensitive belt charging unit 145 applies a uniform positive charge to the surface of the photosensitive belt 133. As a result, the electric potential of the photosensitive layer 169 becomes about +800 volts, for example.

Next, the photosensitive belt 133 is irradiated by a high speed scan by a laser beam from the scanning unit 121 based on image data that is indicative of an yellow color component image of the original image. At the irradiated part, the charge is removed through the electrically-conductive base layer 167 and the roller 139, resulting in that the surface of the photosensitive belt 133 has non-image forming areas with positive charge and image forming areas with charge being lost, thereby forming an electrostatic latent image for the yellow component. The potential at the non-image forming areas are about +800 volts, but the potential at the image forming areas are about +200 volts.

While the photosensitive layer 169 of the photosensitive belt 133 is being uniformly charged by the charging unit 145 and is being irradiated with light by the scanner unit 121, the potential of the base layer 167 in the photosensitive belt 133 is controlled to the ground level by the first photosensitive belt roller 139 and the third photosensitive belt roller 143. In this way, the rollers 139 and 143 serve as an electric energy feeding device for feeding electricity or charges to the base layer 167 of the photosensitive belt 133 at the position where the rollers 139 and 143 are in contact with the base layer 167, thereby maintaining the potential of the base layer 167 at these locations at the ground voltage. Accordingly, it is ensured that the potential of the photosensitive layer 169 becomes the desired voltage of +800 volts accurately when the photosensitive layer 169 is electrified by the charging unit 145, that the potential of the irradiated part of the photosensitive layer 169 becomes the desired voltage of +200 volts accurately when the photosensitive layer 169 is irradiated by light from the scanner unit 121, and that the potential of the non-irradiated part of the photosensitive layer 169 is maintained at the voltage of +800 volts accurately.

The yellow developing cartridge 135Y is moved horizontally forward by the solenoid mechanism (not shown in the drawings), to bring the developing roller 137 of the yellow developing cartridge 135Y into contact with the photosensitive belt 133, onto which the electrostatic latent image for the yellow color component has been formed. Because both of the photosensitive belt 133 and the developing roller 137 rotate counterclockwise, the photosensitive belt 133 and the developing roller 137 move in the opposite direction with each other at their contact position. The developing roller 137 is applied with an electric voltage of about +500 volts. In the toner cartridge 135Y, the yellow toner is positively charged, and is transferred from the developing roller 137 only to the image-forming parts of the photosensitive belt 133, from which charge has already been removed and therefore which has an electric potential of about +200 volts. As a result, a yellow visible image is developed on the photosensitive belt 133.

It is noted that when the yellow developing cartridge 135Y brings its developing roller 137 into contact with the photosensitive belt 133, the magenta developing cartridge 135M, the cyan developing cartridge 135C, and the black developing cartridge 135K are moved horizontally backwards by the solenoid mechanism so as not to contact the photosensitive belt mechanism 133.

By the rotation of the photosensitive belt 133, the position of the photosensitive belt 133, on which the yellow visible image is formed, reaches the position, at which the potential control unit 149 contacts the base layer 167, and then reaches the position, at which the roller 141 contacts the base layer 167 and the yellow visible image on the photosensitive layer 169 confronts the surface of the intermediate transfer belt 151.

When the potential control unit 149 contacts the base layer 167, the potential control unit 149 brings the potential of the base layer 167 to the ground level. When the roller 141 contacts the base layer 167, the roller 141 brings the potential of the base layer 167 to the +300 volts. That is, the roller 141 uses the power source of the photosensitive belt charging unit 145 to apply a voltage of +300 volts to the base layer 167. Because the potential of the base layer 167 has been controlled to the ground level by the potential control unit 149 immediately before the roller 141 applies the voltage of +300 volts to the base layer 167, it is ensured that the potential of the base layer 167 becomes the desired amount of +300 volts accurately by the roller 141. Due to the electrical conductivity of the base layer 167, the portion of the photosensitive layer 169, which is located on the second photosensitive belt roller 141, becomes also at a voltage of +300 volts. Accordingly, a repulsive force develops between the positively charged toner and the photosensitive layer 169. The toner image is therefore easily transferred from the photosensitive belt 133 to the intermediate transfer belt 151.

In the same way as described above, for magenta also, an electrostatic latent image is formed on the photosensitive belt 133, a magenta visible image is then formed on the photosensitive belt 133, and the magenta toner image is transferred to the intermediate transfer belt 151 at a location where the yellow toner image has been transferred.

More specifically, an electrostatic latent image for magenta component of the original image is again formed on the photosensitive belt 133. Next, the magenta developing cartridge 135M is moved forward horizontally by the solenoid mechanism so that the developing roller 137 of the magenta developing cartridge 135M is brought into contact with the photosensitive belt 133. At the same time, the yellow developing cartridge 135Y, the cyan developing cartridge 135C, and the black developing cartridge 135K are moved horizontally backwards by the solenoid mechanism so as not to contact the photosensitive belt mechanism 133. As a result, a magenta toner image is developed on the photosensitive belt 133 by magenta toner. When the movement of the photosensitive belt 133 brings the magenta toner image into substantial confrontation with the intermediate transfer belt 151, the magenta toner image is transferred onto the intermediate transfer belt 151 and is superimposed on the yellow toner image that is already formed on the intermediate transfer belt 151.

The above-described operation is repeated for the cyan toner in the cyan developing cartridge 135C and the black toner in the black developing cartridge 135K, as a result of which a multi-color image is finally formed on the intermediate transfer belt 151.

The multi-color image formed on the intermediate transfer belt 151 is transferred in one operation to the sheet P when the sheet P passes between the intermediate transfer belt 151 and the transfer roller 127 that is now in the transfer position.

In the fixing unit 129, the thermal roller 161 fixes the multi-color image on the sheet P when the sheet P passes between the thermal roller 161 and the pressing roller 163.

Next, the sheet P, onto which the multi-color image has been fixed by the fixing unit 129, is transported by the transport rollers 65 to the pair of discharge rollers 171. The sheet P is then discharged by the discharge rollers 171 to the discharge tray 173 formed on the top of the casing 103.

As described above, when one developing roller 137 in one toner supply device 135 is in contact with the photosensitive belt 133, developing rollers 137 in other three toner supply devices 135 are out of contact with the photosensitive belt 133. The developing roller 137, which is in contact with the photosensitive belt 133, rotates in a counterclockwise direction as indicated by the arrow in FIG. 6. Accordingly, the surface of the developing roller 137 is moving in the opposite direction to the direction of movement of the photosensitive belt 133 at the contact point B, where the photosensitive belt 133 and the developing roller 137 are in contact with each other to transfer polymer toner from the developing roller 137 to the photosensitive belt 133. In this way, the present embodiment employs the opposite-direction developing method similarly to the first embodiment.

The photosensitive belt 133 is supported on the plurality of rollers 139, 141, and 143. The photosensitive belt 133 bends when the photosensitive belt 133 is pushed by the developing roller 137. Accordingly, when the developing roller 137 is in contact with the photosensitive belt 133, the photosensitive belt 133 pushes against the developing roller 137 with a force that is generated due to the tension of the belt 133 only. Accordingly, the photosensitive belt 133 and the developing roller 137 press against each other with a pressing force of 0.22 MPa or less.

Measurements were executed in the same manner as those executed in the first embodiment. In this case, the photosensitive belt 133 pushed against the developing roller 137 with the pressing force of 0.22 MPa or less that was generated due to the tension of the photosensitive belt 133 only. The measurement results were also plotted in the graph of FIG. 5.

It is apparent from the graph of FIG. 5 that pressure fogging did not occur even when the potential difference ΔV between the developing roller 137 and the photosensitive layer 169 was in a range broader than the range of 200 volts to 400 volts that occurs in practice.

Figure 8B:
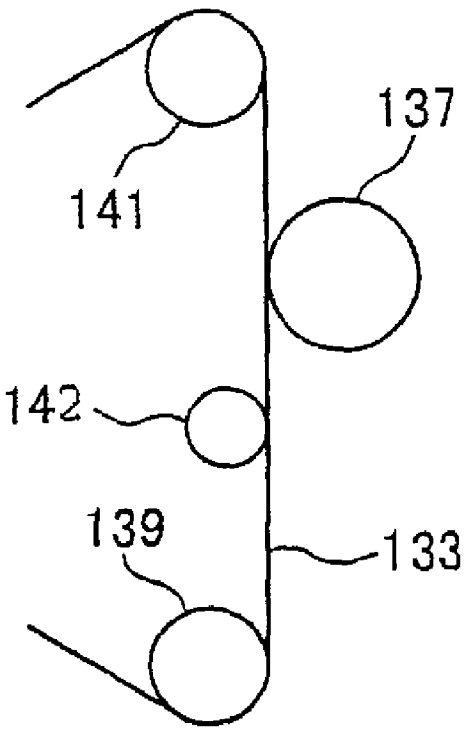
FIG. 8B is a schematic view showing another modification of the second embodiment, in which a tension roller is added.
Figure 8A:
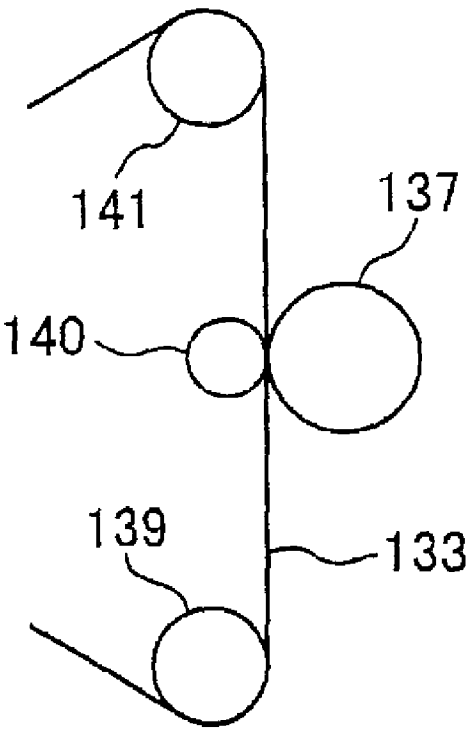
FIG. 8A is a schematic view showing a modification of the second embodiment, in which a back up roller is added.

It is noted that it is possible to increase the pressing force between the photosensitive belt 133 and the developing roller 137 by adding a back up roller 140 as shown in FIG. 8A to sandwich the photosensitive belt 133 between the back up roller 140 and the developing roller 137. A tension roller 142 may be added as shown in FIG. 8B to increase the tension of the photosensitive belt 133, thereby increasing the pressing force between the photosensitive belt 133 and the developing roller 137.

By arranging the position of the back up roller 140 or the position of the tension roller 142, it is possible to freely adjust the pressing force between the photosensitive belt 133 and the developing roller 137.

By setting the pressing force between the photosensitive belt 133 and the developing roller 137 to 0.31 MPa or less, pressure fogging can be prevented when the potential difference ΔV between the photosensitive belt 133 and the developing roller 137 is at the proper value (about 300 volts). By setting the pressing force between the photosensitive belt 133 and the developing roller 137 to 0.24 MPa or less, pressure fogging can be prevented when the potential difference ΔV is within the range of about 200 to about 400 volts that occurs in practice. By setting the pressing force between the photosensitive belt 133 and the developing roller 137 to 0.22 MPa or less, pressure fogging can be prevented even when the potential differenceΔV is in a range broader than the range of 200 to 400 volts that occurs in practice.

According to the present embodiment, because the pressing force between the photosensitive belt 133 and the developing roller 137 is set to 0.22 MPa, pressure fogging can be effectively prevented. Even if the back up roller 140 or the tension roller 142 is added to increase the pressing force, if the pressing force is 0.24 MPa or less, pressure fogging will not occur under the practical range of operating environments, and good quality printing can be carried out. If the pressure is set to be 0.31 MPa or less then pressure fogging will be prevented under the ideal operating environment.

Figure 9:
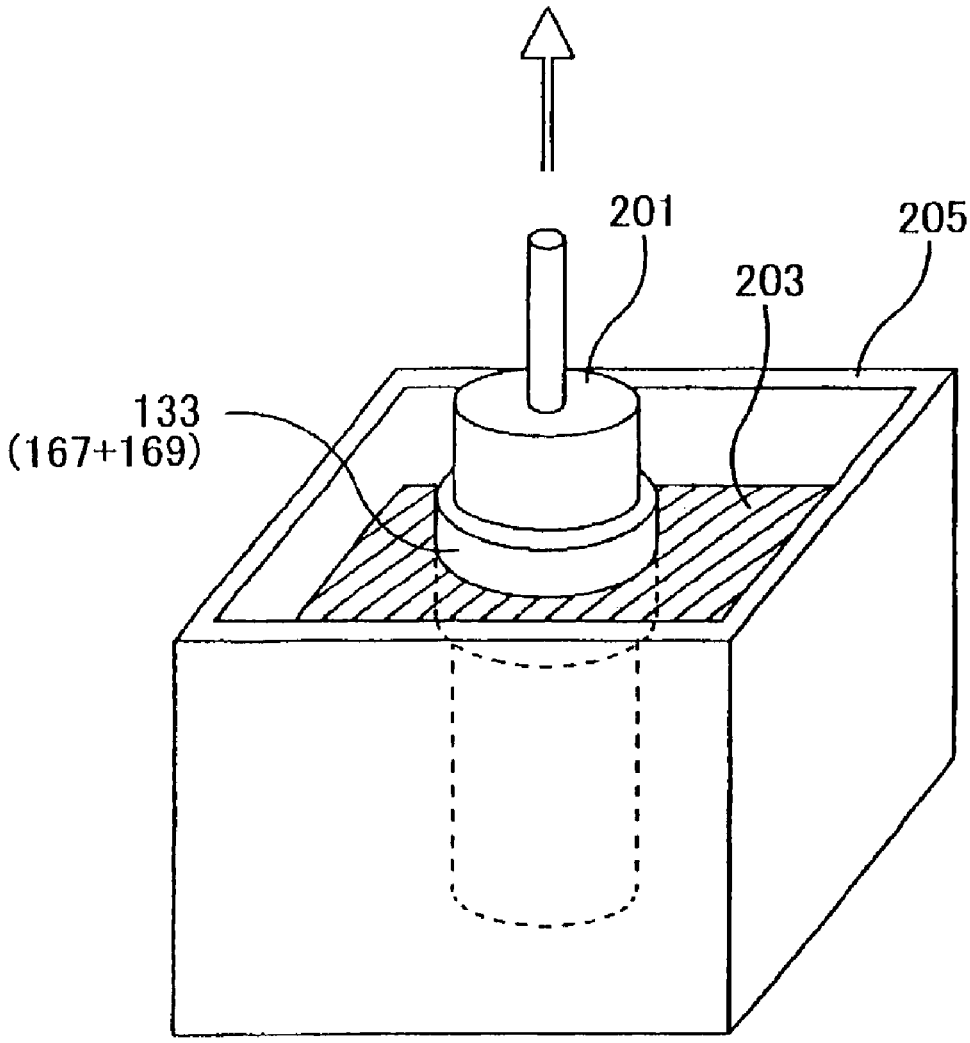
FIG. 9 illustrates a method of manufacturing the photosensitive belt according to the second embodiment.

Next, a method of manufacturing the photosensitive belt 133 will be described with reference to FIG. 9.

First, the base layer 167 is prepared by mixing carbon or ionic conductive agent in polyethylene type resin. By adjusting the amount of the carbon or ionic conductive agent contained in the polyethylene type resin, the volume resistivity of the base layer 167 is set to $1\times10^5$ Ω·cm (ohms-cm), and the surface resistance of the base layer 167 is set to $1\times10^5$ Ω/□ (ohms/square).

The base layer 167 is formed to a predetermined size. Then, a chemical etching is applied to one surface of the base layer 67 to obtain a ten-point average roughness Rz of 1 μm.

Next, the base layer 167 is held and fixed on a cylindrical holder 201, with the chemically-etched surface of the base layer 167 facing outwards, so that the base layer 167 will not bend.

Then, photosensitive liquid 203 is prepared by dissolving photosensitive material (polycarbonate type resin, for example) in a solvent and is poured in a container 205.

The holder 201 is placed in the container 205 to completely immerse the base layer 167 in the photosensitive liquid 203.

The holder 201 is raised at a predetermined fixed speed from the photosensitive liquid 203. The solvent evaporates from a part of the photosensitive liquid 203 that is attached to the outer surface of the base layer 167. As a result, the photosensitive layer 169 formed of the photosensitive material is formed on the outer surface of the base layer 167. It is noted that as the holder-raising speed increases, the thickness of the photosensitive layer 169 formed also increases.

In the above description, the base layer 67 is chemically etched to the ten-point average roughness Rz of 1 μm. However, it is sufficient to chemically etch the surface of the base layer 167 to the ten-point average roughness Rz in a range of 0.01 to 10 μm. This is because when the roughness of the surface of the base layer 167, on which the photosensitive layer 169 is formed, is within the range of 0.01 to 10 μm, then the adhesion between the base layer 167 and the photosensitive layer 169 becomes sufficiently high. The photosensitive layer 169 does not easily peel from the base layer 167, and durability is improved.

In the above description, the base layer 167 is prepared to have the volume resistivity of $1\times10^5$ Ω·cm (ohms-cm) and the surface resistance of $1\times10^5$ Ω/□ (ohms/square). However, it is sufficient to prepare the base layer 167 so as to have the volume resistivity in a range of $10^3$ Ω·cm (ohms-cm) to $10^9$ Ω·cm (ohms-cm) and the surface resistance greater than or equal to $2\times10^4$ Ω/□ (ohms/square).

By setting the volume resistivity greater than or equal to $10^3$ Ω·cm (ohms-cm), it is possible to reduce the quantity of carbon included in the base layer 167. This reduces the fragility of the photosensitive belt 133, and therefore the durability of the photosensitive belt 133 is improved. By setting the volume resistivity smaller than or equal to $10^9$ Ω·cm (ohms-cm), the first and third rollers 139 and 143 can feed electric energy to the base layer 167. By setting the surface resistance greater than or equal to $2\times10^4$ Ω/□ (ohms/square), it is possible to prevent a short circuit from occurring between the potential control unit 149 and the second photosensitive belt roller 141.

As described above, according to the present embodiment, the base layer 167 has the volume resistivity of greater than or equal to $10^3$ Ω·cm (ohms-cm). Accordingly, it is possible to reduce the quantity of carbon included in the base layer 167 that is added in the base layer 167 to provide electrical conductivity. This reduces the fragility of the photosensitive belt 133, and the durability of the photosensitive belt 133 is improved.

Because the volume resistivity of the base layer 167 is less than or equal to $10^9$ Ω·cm (ohms-cm), the first and third photosensitive belt rollers 139 and 143 can feed electric energy to base layer 167. Accordingly, it is possible to use the rollers 139 and 143 that support the photosensitive belt 133 as electric-energy feeding units feeding electric energy to the photosensitive belt 133. It is unnecessary to provide an independent electric-energy feeding unit, and therefore the configuration of the color laser printer 1 is simplified and the cost of manufacture can be reduced.

The base layer 167 has a surface resistance of greater than or equal to $2\times10^4$ Ω/□ (ohms/square). Accordingly, there will occur no short circuit between the potential control unit 149 and the second photosensitive belt roller 141. More specifically, the base layer 167 is at the GND voltage at the position where the base layer 167 is in contact with the potential control unit 149. On the other hand, the base layer 167 is at a voltage of +300 volts at the position where the base layer 167 is in contact with the second photosensitive belt roller 141. Because the surface resistance of the base layer 167 is sufficiently high, there is no likelihood of a large electric current flowing between the potential control unit 149 and the second photosensitive belt roller 141.

The voltage application unit 147 applies a voltage of the same polarity as that of the charged toner to the position of the base layer 167, where the photosensitive belt 133 contacts the intermediate transfer belt 151. This makes it easy to transfer the visible toner image from the photosensitive belt 133 to the intermediate transfer belt 151. On the other hand, the GND voltage is applied to other positions of the base layer 167, where the base layer 167 contacts the rollers 143 and 139. This makes it easy to form the electrostatic latent image on the photosensitive belt 133.

The base layer 167 has a surface resistance greater than or equal to the predetermined value of $2\times10^4$ Ω/□ (ohms/square). This will prevent a large electrical current from flowing between the position of the base layer 167 where the photosensitive belt 133 contacts the intermediate transfer belt 151 and the positions of the base layer 167 where the base layer 167 contacts the rollers 143 and 139.

The potential control unit 149 is provided at a position of the base layer 167 between the position of the base layer 167 where the photosensitive belt 133 contacts the intermediate transfer belt 151 and the positions of the base layer 167 where the base layer 167 contacts the rollers 143 and 139. The potential control unit 149 controls the potential of the base layer 167. Accordingly, it is possible to maintain, at their respective predetermined potentials, the position of the base layer 167 where the photosensitive belt 133 contacts the intermediate transfer belt 151 and the positions of the base layer 167 where the base layer 167 contacts the rollers 143 and 139. Because the potential control unit 149 controls the potential of the base layer 167 to the ground voltage, it is ensured that the roller 141 establishes the potential of +300 volts accurately on the base layer 167.

Because the base layer 167 has a surface resistance greater than or equal to the predetermined value of $2\times10^4$ Ω/□ (ohms/square), it is also possible to prevent a large electrical current from flowing: between the position of the base layer 167 where the photosensitive belt 133 contacts the intermediate transfer belt 151 and the position of the base layer 167 where the base layer 167 contacts the potential control unit 149; and between the position of the base layer 167 where the base layer 167 contacts the potential control unit 149 and the positions of the base layer 167 where the base layer 167 contacts the rollers 143 and 139.

The charging unit 145 electrically charges the photosensitive layer 169. The voltage application unit 147 uses the power source of the charging unit 145 to apply the voltage to the position of the base layer 167 where the photosensitive belt 133 contacts the intermediate transfer belt 151. It is unnecessary to provide an independent power source to apply voltage to the position of the base layer 167 where the photosensitive belt 133 contacts the intermediate transfer belt 151. Accordingly, the configuration of the color laser printer 101 is simplified and the cost of manufacture thereof can be reduced.

As described above, in the color laser printer 101 according to the present embodiment, after an electrostatic latent image is formed on the photosensitive belt 133, a toner image is developed by polymer toner supplied from the developing roller 137 according to the opposite-direction developing method while the developing roller 137 is pressed against the photosensitive belt 133 at a pressing force of 0.22 MPa. Accordingly, occurrence of pressure fogging is prevented.

The photosensitive belt 133 has a simple two-layer structure. That is, the photosensitive belt 133 consists of: the base layer 167 made from electrically conductive resin; and the photosensitive layer 167 made from organic photosensitive material and provided over the base layer 167. The configuration of the photosensitive belt 133 is simplified, and the manufacturing cost thereof can be reduced, and the durability of the photosensitive belt 133 is improved.

Additionally, the first and second rollers 139 and 143 that support the photosensitive belt 133 serve to feed electric energy to the photosensitive belt 133. Accordingly, the entire printer 101 can be made small.

As described above, according to the present embodiment, the photosensitive belt 133 is made from the base layer 167 and the photosensitive layer 169 only. It is unnecessary to provide a vapor deposition layer between the base layer 167 and the photosensitive layer 169 or to provide an electrically conductive layer on the vapor deposition layer. Therefore, the manufacture of the photosensitive belt 133 is simplified, and the manufacturing cost can be reduced.

Because the photosensitive layer 169 is fixed directly to the base layer 167, there is no mechanically weak vapor deposition layer between the photosensitive layer 169 and the base layer 167. Accordingly, the adhesion between the photosensitive layer 169 and the base layer 167 is high. The photosensitive layer 169 does not easily peel from the base layer 167, and the durability of the photosensitive belt 133 is improved.

Especially, according to the present embodiment, the photosensitive layer 169 is provided on the base layer 167 after the base layer 167 is chemically etched. Accordingly, the adhesion between the base layer 167 and the photosensitive layer 169 is increased still more. As a result, the photosensitive layer 169 does not easily peel from the base layer 167, and superior durability is obtained.

The surface of the base layer 167, on which the photosensitive layer 169 is formed, is processed to have a ten-point average surface roughness Rz in the range of 0.01 to 10 μm. Therefore, the adhesion between the base layer 167 and the photosensitive layer 169 become high. The photosensitive layer 169 does not easily peel from the base layer 167, and the durability of the photosensitive belt 133 is improved.

The first and second photosensitive belt rollers 139 and 143 feed electric energy to the base layer 167. It is unnecessary to provide a separate electrical charging brush to feed electric energy to the base layer 167.

In this way, the base layer 167 is supplied with electric energy from the side on which the photosensitive layer 169 is not formed. Accordingly, it is unnecessary to provide any electrically-conductive member on the side of the photosensitive layer 169. The structure of the photosensitive belt 133 is simplified. It is possible to reduce the manufacturing cost of the laser printer 101.

The first and second photosensitive belt rollers 139 and 143 that support the photosensitive belt 133 are used also for feeding electric energy. Because the rollers 139 and 143 are in direct contact with the base layer 167, the rollers 139 and 143 can feed electric energy to the base layer 167 at positions where the rollers 139 and 143 contact the base layer 167.

The rollers 139 and 143 support the photosensitive belt 133 on their outer circumferential surface. Rotation of the rollers 139 and 143 enables the photosensitive belt 133 to move to rotate. It is possible to feed electric energy to the base layer 167 at the positions of the outer circumferential surface of rollers 139 and 143, where the rollers 139 and 143 contact the base layer 167.

It is unnecessary to provide a separate electric energy feeding device. The color laser printer 101 can be simplified, and the manufacturing cost thereof can be reduced still more.

In this way, the configuration of the color laser printer 101 can be simplified, and the cost of manufacture thereof can be reduced. The color laser printer 101 can be reduced also in size.

In the above description, the surface of the base layer 167, on which the photosensitive layer 169 is bonded, is roughened by a chemical etching. However, the surface of the base layer 167, on which the photosensitive layer 169 is bonded, may be roughened using a blast process. This will increase the adhesion between the base layer 167 and the photosensitive layer 169. The photosensitive layer 169 will not easily peel from the base layer 167, and the durability of the photosensitive belt 133 is improved.

In the above description, the base layer 167 is made from polyethylene type resin. However, the base layer 167 can be made from other material. For example, the base layer 167 can be made from polycarbonate type resin. In this case, it is possible to positively charge the photosensitive layer 169. The base layer 167 can be made from a polyamide type resin. In this case, it is possible to negatively charge the photosensitive layer 169.

Figure 10A:
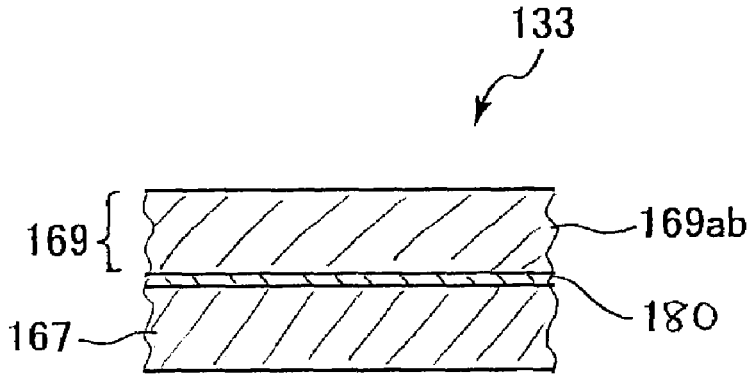
FIG. 10A is a schematic view showing a modification of the photosensitive belt of the second embodiment.
Figure 10B:
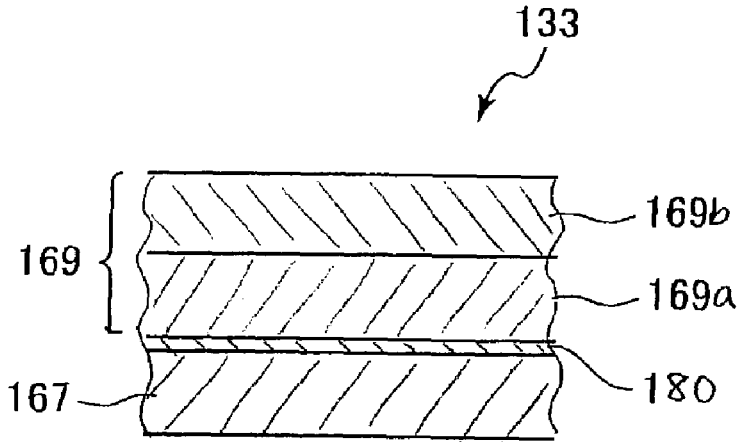
FIG. 10B is a schematic view showing another modification of the photosensitive belt of the second embodiment.

In the above description, the photosensitive layer 169 is provided directly over the base layer 167. However, the photosensitive layer 169 may be provided indirectly over the base layer 167. That is, the photosensitive layer 169 may be provided over the base layer 167 via an undercoat layer 180 as shown in FIGS. 10A and 10B. The undercoat layer 180 is made from polyamide.

More specifically, when the base layer 167 is made from polycarbonate type resin or polyethylene type resin, as shown in FIG. 10A, the photosensitive layer 169 is formed from a charge generating-and-transporting layer 169*ab*. The charge generating-and-transporting layer 169*ab* is provided over the base layer 167 with the polyamide undercoat layer 180 being provided between the charge generating-and-transporting layer 169*ab* and the base layer 167. In this case, the photosensitive belt 133 having the layers 167, 180, and 169*ab* can be charged positively.

Alternatively, when the base layer 167 is made from a polyamide type resin, as shown in FIG. 10B, the photosensitive layer 169 is formed from a charge generating layer 169*a* and a charge transporting layer 169*b*. The charge transporting layer 169*b* is provided over the charge generating layer 169*a*. The charge generating layer 169*a* is provided over the base layer 167 with the polyamide undercoat layer 180 being provided between the charge generating layer 169*a* and the base layer 167. In this case, the photosensitive belt 133 having the layers 167, 180, 169*a*, and 169*b* can be charged negatively.

The photoconductive layer 169 may be formed from other organic photosensitive material such as a phthalocyanine OPC (Organic Photo Conductor).

While the invention has been described in detail with reference to the specific embodiments thereof, it would be apparent to those skilled in the art that various changes and modifications may be made therein without departing from the spirit of the invention.

For example, the polymer toner does not have to be made by the suspension polymerization method. The polymer toner can be prepared by other various manners, such as an emulsification polymerization. Silica or titanium oxide may be added to the polymer toner in order to improve the fluidity.

The present invention can be applied not only to laser printers, but also to other image forming apparatuses, such as facsimile machine, copy machines, or the like.

In the second embodiment, polymer toner is used and the opposite-direction developing method is employed. However, developing agent of types other than polymer toner may be used. The same-direction developing method may be employed. In such a case, the pressing force between the developing roller 137 and the photosensitive belt 133 may be greater than 0.31 MPa.

What is claimed is:

1. An image forming apparatus, comprising:

a photosensitive belt including:

an electrically conductive base layer having one surface and another surface opposite to the one surface;

a photosensitive layer provided over the one surface of the electrically conductive base layer for forming an electrostatic latent image thereon;

an energy feeding unit feeding an electric energy to the another surface of the electrically conductive base layer and maintaining the electrically conductive base layer at a ground voltage;

an electric potential establishing unit establishing a first electric potential on the electrically conductive base layer at a first position of the photosensitive belt;

an image forming unit that forms an image on the photosensitive belt; and a charging unit electrifying the photosensitive layer of the photosensitive belt, the charging unit having a power source to electrify the photosensitive layer, wherein the energy feeding unit contacts the electrically conductive base layer at a second position of the photosensitive belt, thereby establishing a second electric potential on the electrically conductive base layer at the second position, the second position being different from the first position, the second electric potential being different from the first electric potential, wherein the electric potential establishing unit contacts the electrically conductive base layer at the first position of the photosensitive belt, thereby establishing the first electric potential on the electrically conductive base layer at the first position, and wherein the electric potential establishing unit is electrically connected to the power source to establish the first electric potential on the electrically conductive base layer at the first position.

2. An image forming apparatus as claimed in claim 1, wherein the energy feeding unit includes a supporting member that is in direct contact with the another surface of the electrically conductive base layer, thereby supporting the photosensitive belt thereon, the supporting member feeding electric energy to the electrically conductive base layer at a position where the supporting member and the another surface of the electrically conductive base layer are in contact with each other, thereby maintaining the electrically conductive base layer at a ground voltage.

3. An image forming apparatus as claimed in claim 2, wherein the supporting member includes a roller member rotating to allow the photosensitive belt to rotate around the supporting member.

4. An image forming apparatus as claimed in claim 1, wherein the image forming unit includes:

a scanning unit scanning a light beam on the photosensitive layer at the second position of the photosensitive belt, to thereby form an electrostatic latent image on the photosensitive layer, the second electric potential established on the electrically conductive base layer at the second position being equal to a ground potential;

a developing unit supplying an electrically-charged developing agent to the photosensitive belt, thereby developing the electrostatic latent image into a developing agent visible image; and an intermediate transfer member contacting the photosensitive belt at the first position, the electric potential establishing unit establishing the first electric potential on the electrically conductive base layer at the first position of the photosensitive belt, the first electric potential having a polarity the same as that of the charged developing agent, thereby allowing the developing agent visible image to be transferred from the photosensitive belt to the intermediate transfer member at the first position.

5. An image forming apparatus as claimed in claim 1, further comprising a potential control unit controlling an electric potential of the electrically conductive base layer at its position between the first position and the second position, wherein the potential control unit contacts the electrically conductive base layer at the position between the first position and the second position, thereby maintaining the electrically conductive base layer at a ground voltage.

6. An image forming apparatus as claimed in claim 1, wherein the photosensitive layer includes a charge generating-and-transporting layer.

7. An image forming apparatus as claimed in claim 6, wherein the charge generating-and-transporting layer includes a charge generating layer and a charge transporting layer which are provided one on the other.

8. An image forming apparatus as claimed in claim 7, wherein the photosensitive layer is provided over the electrically conductive base layer via an undercoat layer that is made from polyamide.

9. An image forming apparatus as claimed in claim 1, wherein the photosensitive layer includes polycarbonate type resin.

10. An image forming apparatus as claimed in claim 1, wherein the electrically conductive base layer is made from polyamide type resin.

11. An image forming apparatus as claimed in claim 1, wherein the electrically conductive base layer is made from polyethylene type resin.

12. An image forming apparatus as claimed in claim 1, wherein the electrically conductive base layer is made from polycarbonate type resin.

13. An image forming apparatus as claimed in claim 1, wherein the photosensitive layer is formed directly over the electrically conductive base layer.

14. An image forming apparatus as claimed in claim 13, wherein a surface of the electrically conductive base layer, on which the photosensitive layer is formed, has a ten-point average surface roughness Rz in a range of 0.01 to 10 μm.

15. An image forming apparatus as claimed in claim 13, wherein the surface of the electrically conductive base layer, on which the photosensitive layer is formed, is roughened by a chemical etching process.

16. An image forming apparatus as claimed in claim 13, wherein the surface of the electrically conductive base layer, on which the photosensitive layer is formed, is roughened by a blast process.

17. An image forming apparatus as claimed in claim 1, wherein the electrically conductive base layer has a volume resistivity in a range of $10^3$ to $10^9$ Ω·cm (ohms-cm).

18. An image forming apparatus as claimed in claim 1, wherein the electrically conductive base layer has a surface resistance of greater than or equal to $2\times10^4$ Ω/□(ohms/square).

* * * * *